US007661790B2

(12) United States Patent
Harada et al.

(10) Patent No.: US 7,661,790 B2
(45) Date of Patent: Feb. 16, 2010

(54) LIQUID RECOVERY CONTAINERS AND LIQUID EJECTION APPARATUS

(75) Inventors: Shuhei Harada, Nagano-ken (JP); Keiji Matsumoto, Nagano-ken (JP); Manabu Yamada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 341 days.

(21) Appl. No.: 11/188,108

(22) Filed: Jul. 25, 2005

(65) Prior Publication Data

US 2006/0017770 A1 Jan. 26, 2006

(30) Foreign Application Priority Data

Jul. 23, 2004 (JP) ..... 2004-216451
Jan. 17, 2005 (JP) ..... 2005-009437
Jun. 23, 2005 (JP) ..... 2005-183829

(51) Int. Cl.
*B41J 2/165* (2006.01)

(52) U.S. Cl. ..... 347/36; 347/29; 347/30; 347/31; 347/32; 347/35

(58) Field of Classification Search ..... 347/29–36
See application file for complete search history.

(56) References Cited

U.S. PATENT DOCUMENTS 4,229,747 A * 10/1980 Hwang ..... 347/100
4,380,018 A * 4/1983 Andoh et al. ..... 347/68
6,203,138 B1 * 3/2001 Hirabayashi et al. ..... 347/36
6,267,465 B1 * 7/2001 Sawicki ..... 347/36
6,709,088 B2 * 3/2004 Hayakawa et al. ..... 347/31
6,786,567 B1 * 9/2004 Yoshino ..... 347/36
6,809,047 B2 * 10/2004 Lebold et al. ..... 442/392
6,890,057 B2 * 5/2005 Gotoh et al. ..... 347/36
7,111,923 B2 * 9/2006 Kulpa ..... 347/36
7,360,864 B2 4/2008 Kawai et al.

FOREIGN PATENT DOCUMENTS

JP 06-198913 A 7/1994
JP 06340092 A 12/1994
JP 11-078053 A 3/1999
JP 2004-34361 A 2/2004

* cited by examiner

*Primary Examiner*—Shih-wen Hsieh
(74) *Attorney, Agent, or Firm*—Sughrue Mion, PLLC

(57) ABSTRACT

First, second, and third ink absorbing bodies are accommodated in a container of a recovery reservoir in this order from the side corresponding to a bottom surface of the container, so that an introduction chamber is defined in the middle of a recovery space. A lid having a shutter plate and a communication hole is located over the third ink absorbing body. The upper side of the introduction chamber is covered by the shutter plate to suppress volatilization of solvent element of waste ink introduced into the introduction chamber. In addition, the communication hole is located in a portion of the upper surface of the third ink absorbing body, so that solvent element of ink absorbed by the third ink absorption body volatilizes.

19 Claims, 11 Drawing Sheets

LIQUID RECOVERY CONTAINERS AND LIQUID EJECTION APPARATUS

BACKGROUND OF THE INVENTION

The present invention relates to liquid recovery containers and liquid ejection apparatuses.

As a liquid ejection apparatus ejecting liquid to a target, an inkjet type printer (hereinafter, simply referred to as a "printer") ejecting ink to a recording medium is known. When necessary, the printer performs cleaning for removing the ink having increased viscosity from ink ejection nozzles, thus suppressing ink ejection problems.

In cleaning, a cap seals a nozzle forming surface in which the nozzles are formed. The airtight space defined between the nozzle forming surface and the cap (an in-cap space) is subjected to suction by a suction pump. This applies negative pressure acting in an ink ejection direction to the in-cap space. The negative pressure draws the ink, which has increased viscosity, from the nozzles.

After having been drawn from the nozzles by the suction pump, the ink is recovered by an ink recovery reservoir, or a liquid recovery container. The ink recovery reservoir includes a box-shaped recovery container having an upper opening and an ink absorption body accommodated in the recovery container. The ink recovery reservoir retains the ink drawn by the suction pump (hereinafter, simply referred to as the "waste ink") in a state absorbed by the ink absorption body. Further, the ink recovery reservoir allows some solvent of the ink to volatilize from the upper opening of the recovery container, thus reducing the quantity of the retained ink. This improves the recovery efficiency of the ink recovery reservoir.

In recent cases, the above-described printer may use pigment ink or high-concentration ink for prolonging the life of an image printed by the printer or improving color expression of the image. Generally, in these cases, an element of the ink (for example, a pigment) easily condenses and solidifies due to volatilization or absorption of the solvent of the ink. Thus, if the ink recovery reservoir recovers the ink, the solidified ink element, or an ink residue, is deposited on a wall of the ink recovery reservoir (particularly, in the vicinity of a discharge port through which the waste ink is introduced into the recovery reservoir). The deposits hamper absorption of the waste ink and lower the performance of the ink recovery reservoir.

Conventionally, for the ink recovery reservoirs for recovering the aforementioned types of ink, techniques for preventing the ink residue from lowering the ink recovery performance have been proposed (for example, see Japanese Laid-Open Patent Publication No. 2004-34361). In the ink recovery reservoir described by the document, the waste ink discharged from the discharge port moves (diffuses) along the bottom surface of the ink recovery reservoir. The diffused ink is then absorbed by the ink absorption body. Since the diffused ink reduces the thickness of the ink residue, the contact area between the waste ink and the ink absorption body becomes relatively large. Therefore, compared to a case in which the waste ink is dropped on the ink absorption body from above and absorbed by the absorption body, the performance of the ink absorption body is maintained at a relatively high level. The performance of the ink recovery reservoir is thus prevented from being lowered.

However, the waste ink recovered by the ink recovery reservoir contains a large amount of bubbles generated from the air trapped in the in-cap space. This may cause the following problems.

When reaching the bottom surface of the recovery container, the bubbles in the waste ink may settle on the bottom surface of the recovery container and some of the bubbles may hamper diffusion of the ink. This may cause the ink to accumulate on the bottom surface of the recovery container. The solvent of the accumulated ink volatilizes from the upper opening of the recovery container, and the ink element solidifies. As a result, an ink residue is deposited on the bottom surface of the ink recovery reservoir, in the vicinity of the discharge port in particular, thus hampering ink absorption by the ink absorption body. This lowers the performance of the ink recovery reservoir.

Further, if the ink absorption body is exposed to the atmospheric air and an excessive amount of ink solvent volatilizes, a non-volatile element of the waste ink, such as the pigment, condenses and solidifies. The solidified element blocks pores of the ink absorption body, thus hampering permeability of the ink absorption body to the ink. Further, if the waste ink dries continuously, the non-volatile element of the ink condenses and the resulting condense increases in quantity, hampering permeation of the waste ink in the ink absorption body. This may cause overflow of the ink from the ink absorption body.

SUMMARY OF THE INVENTION

Accordingly, it is an objective of the present invention to provide a liquid recovery container capable of smoothly absorbing and recovering a liquid discharged from a discharge port and a liquid ejection apparatus having the liquid recovery container.

To achieve the foregoing and other objectives and in accordance with the purpose of the present invention, the invention provides a liquid recovery container having a liquid absorption body for absorbing a liquid, and a container body for accommodating the liquid absorption body. A discharge port is provided for discharging the liquid toward one of the container body and the liquid absorption body. Some of the liquid discharged from the discharge port and absorbed by the liquid absorption body is allowed to volatilize from an opening defined in the container body. The container includes a cover member covering the discharge port and at least a portion of the liquid absorption body in the vicinity of the discharge port for suppressing volatilization of the liquid discharged from the discharge port.

The present invention also provides a liquid ejection apparatus including a liquid ejection head for ejecting a liquid retained in liquid retainer means and seal means for sealing a nozzle forming surface in which a plurality of nozzles of the liquid ejection head are defined. The liquid discharged into a space defined by the nozzle forming surface and the seal means through the nozzles is recovered through a discharge port. The apparatus includes a liquid absorption body for absorbing a liquid, a container body for accommodating the liquid absorption body, and a cover member. The discharge port discharges the liquid toward one of the container body and the liquid absorption body. Some of the liquid discharged from the discharge port and absorbed by the liquid absorption body is allowed to volatilize from an opening defined in the container body. The cover member covers the discharge port and at least a portion of the liquid absorption body in the vicinity of the discharge port for suppressing volatilization of the liquid discharged from the discharge port.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An inkjet type printer according to a first embodiment of the present invention will now be described with reference to FIGS. 1 to 4.

Figure 1:
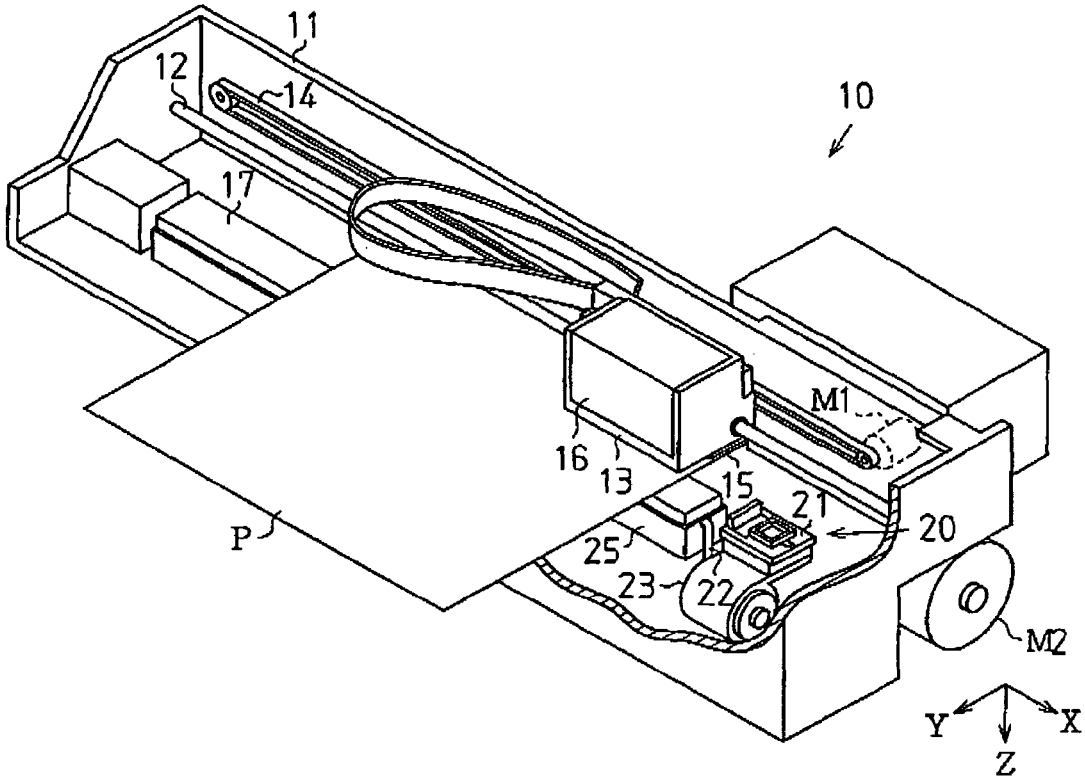
FIG. 1 is a perspective view showing an inkjet type printer according to a first embodiment of the present invention.
Figure 2:
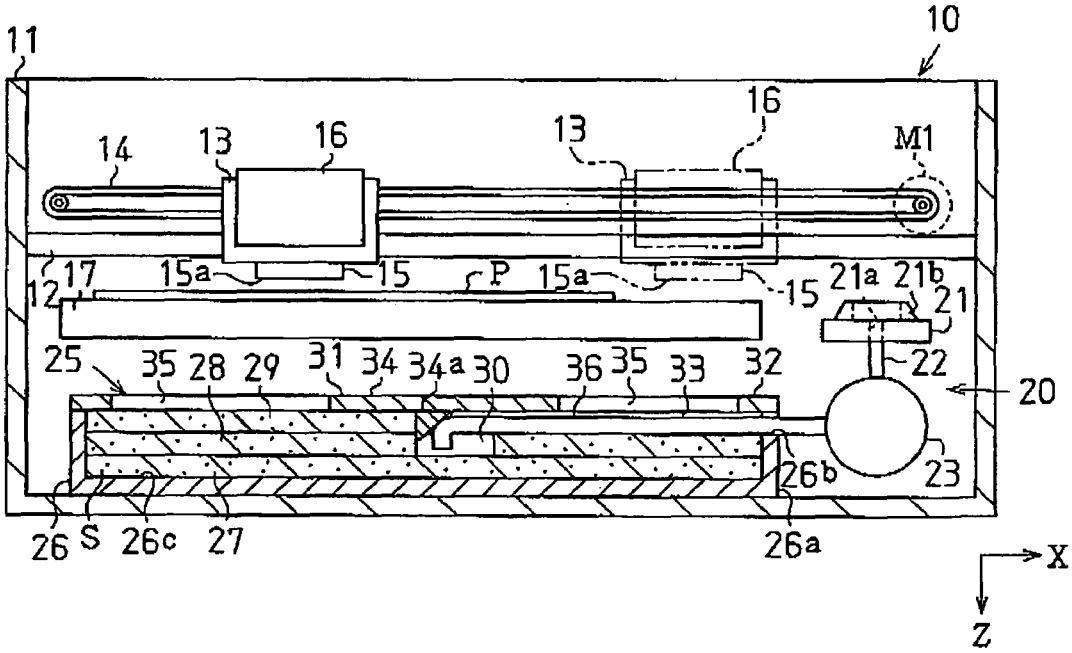
FIG. 2 is a front cross-sectional view schematically showing a main portion of the printer of FIG. 1.

FIG. 1 is a perspective view showing the printer and FIG. 2 is a front cross-sectional view schematically showing a main portion of the printer. As shown in FIG. 1, the inkjet type printer 10 (hereinafter, simply referred to as the "printer 10") serving as a liquid ejection apparatus includes a body casing 11. The body casing 11 has a substantially box-like shape and accommodates the printer 10 as a whole.

Referring to FIG. 1, a rod-like guide member 12 extends longitudinally (in lateral direction X of FIG. 1) in the body casing 11. A carriage 13 is passed through the guide member 12 movably in lateral direction X. The carriage 13 is connected to a carriage motor M1 through a timing belt 14 and driven by the carriage motor M1.

When the carriage motor M1 runs, the drive force of the carriage motor M1 is transmitted to the carriage 13 through the timing belt 14. The carriage 13 thus reciprocates in direction X as guided by the guide member 12.

As shown in FIG. 2, a recording head 15, or a liquid ejection head, is secured to a lower surface of the carriage 13. A nozzle forming surface 15*a* is formed at a lower surface of the recording head 15. Multiple non-illustrated liquid ejection nozzles (hereinafter, "nozzles") are formed in the nozzle forming surface 15*a* for ejecting liquid.

As shown in FIG. 1, an ink cartridge 16 serving as a liquid retainer means is removably installed in the carriage 13 at a position above the recording head 15. The ink cartridge 16 retains ink, which is liquid, and supplies the ink to the recording head 15. In the first embodiment, pigment ink is employed as the ink. The pigment ink contains volatile, water-soluble solvent (a solvent element) and non-volatile pigment diffused by a diffusion agent (a diffusion element). However, the ink is not restricted to the pigment ink but may be other types of ink consisting of elements different from the aforementioned elements.

Referring to FIG. 1, a platen 17 is provided below the carriage 13. The platen 17 serves as a support table for supporting a recording paper P, or a target. A non-illustrated paper feeder mechanism is formed on an upper surface of the platen 17. The paper feeder mechanism is operated through actuation of a paper feeder motor M2 for feeding the recording paper P in a direction perpendicular to lateral direction X (in front-rear direction Y of FIG. 1).

When receiving an image signal generated in correspondence with image data, the printer 10 actuates the paper feeder motor M2 and sends the recording paper P forward with respect to front-rear direction Y. Meanwhile, the printer 10 actuates the carriage motor M1 and reciprocates the carriage 13 in lateral direction X. Also, the printer 10 ejects ink drops from the recording head 15, which also reciprocates, thus subjecting the recording paper P to printing.

As viewed in FIG. 1, a non-printing area, in which printing is not performed, is defined in a right section of the space defined by the body casing 11. A cleaning mechanism 20 is received in the non-printing area. The cleaning mechanism 20 includes a cap 21 serving as a seal means, a discharge tube 22, a suction pump 23, and a recovery reservoir 25 serving as a liquid recovery container defining a recovery means.

The cap 21 is shaped like a box with an upper opening, as shown in FIG. 2. The cap 21 is supported by a non-illustrated lift mechanism formed in the non-printing area and, in this state, permitted to reciprocate in a direction perpendicular to lateral direction x and front-rear direction Y (in vertical direction Z of FIG. 2). A suction hole 21*a* extends through the bottom surface of the cap 21 along vertical direction Z. A square, outer frame 21*b* formed of flexible material is secured to an upper end of the cap 21.

When the recording head 15 enters the non-printing area and the cap 21 is raised, the outer frame 21*b* of the cap 21 contacts the recording head 15 and seals the nozzle forming surface 15*a*. Accordingly, a space for sealing the nozzle forming surface 15*a*, which will be mentioned to as an "in-cap space", is defined in the cap 21.

A recovery reservoir 25 is arranged on the bottom surface of the body casing 11 and below the platen 17. As shown in FIGS. 1 and 2, the recovery reservoir 25 is formed by a parallelepiped container. The space defined by the container is connected to the in-cap space through the discharge tube 22 communicating with the suction hole 21*a*. The suction pump 23 is provided in the discharge tube 22 and driven by a non-illustrated pump motor The suction pump 23 generates negative pressure in correspondence with the suction force of the suction pump 23 and applies the negative pressure to the in-cap space.

In this state, the ink in the recording head 15 having increased viscosity is drawn from the nozzles to the in-cap space, and the recording head 15 is cleaned. The ink is then drawn from the in-cap space by the suction pump 23 and recovered by the recovery reservoir 25, which is located downstream from the discharge tube 22, as ink containing gas of the in-cap space (bubbles), or waste ink.

Figure 3:
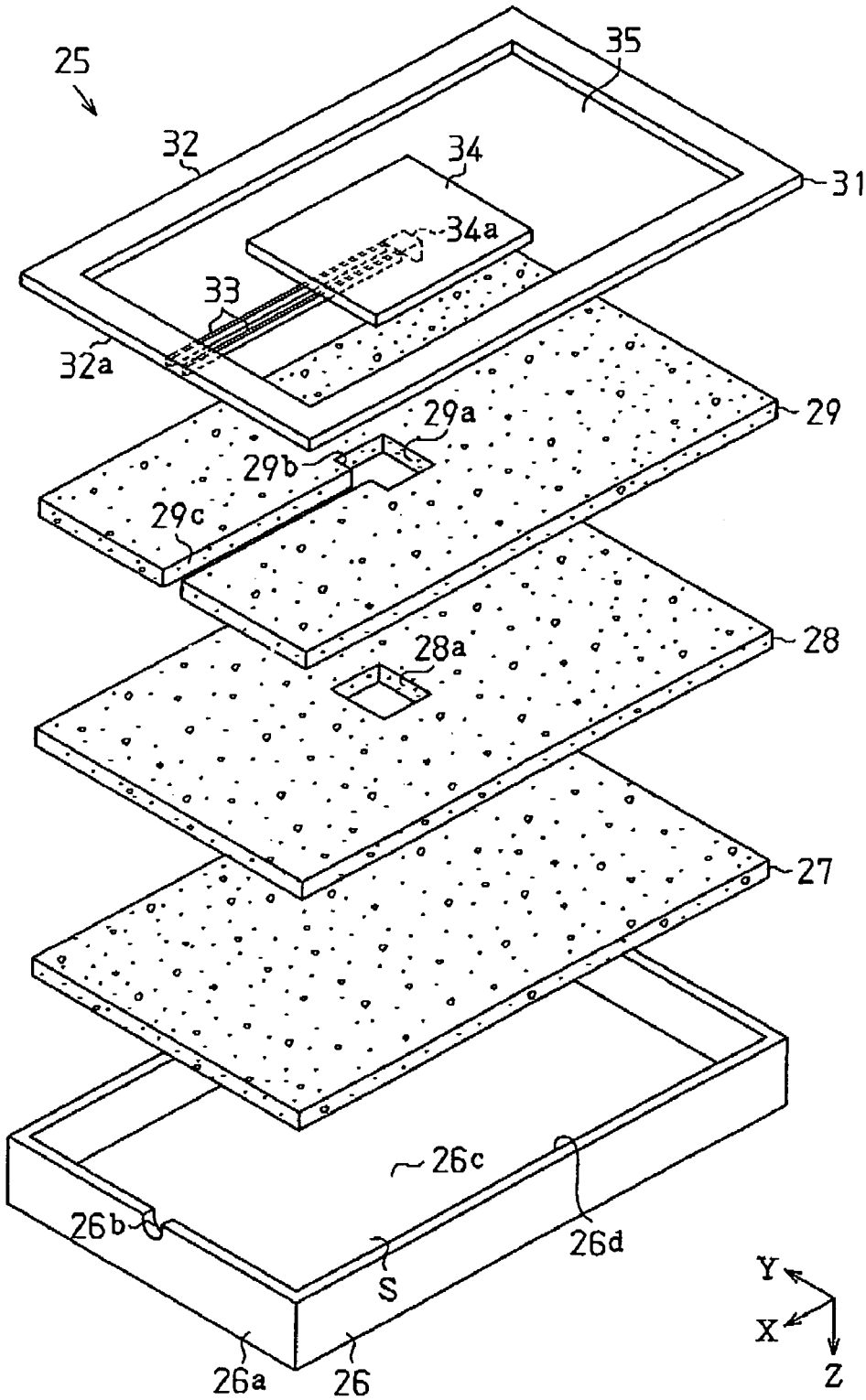
FIG. 3 is an exploded perspective view showing a recovery reservoir of the first embodiment.
Figure 4:
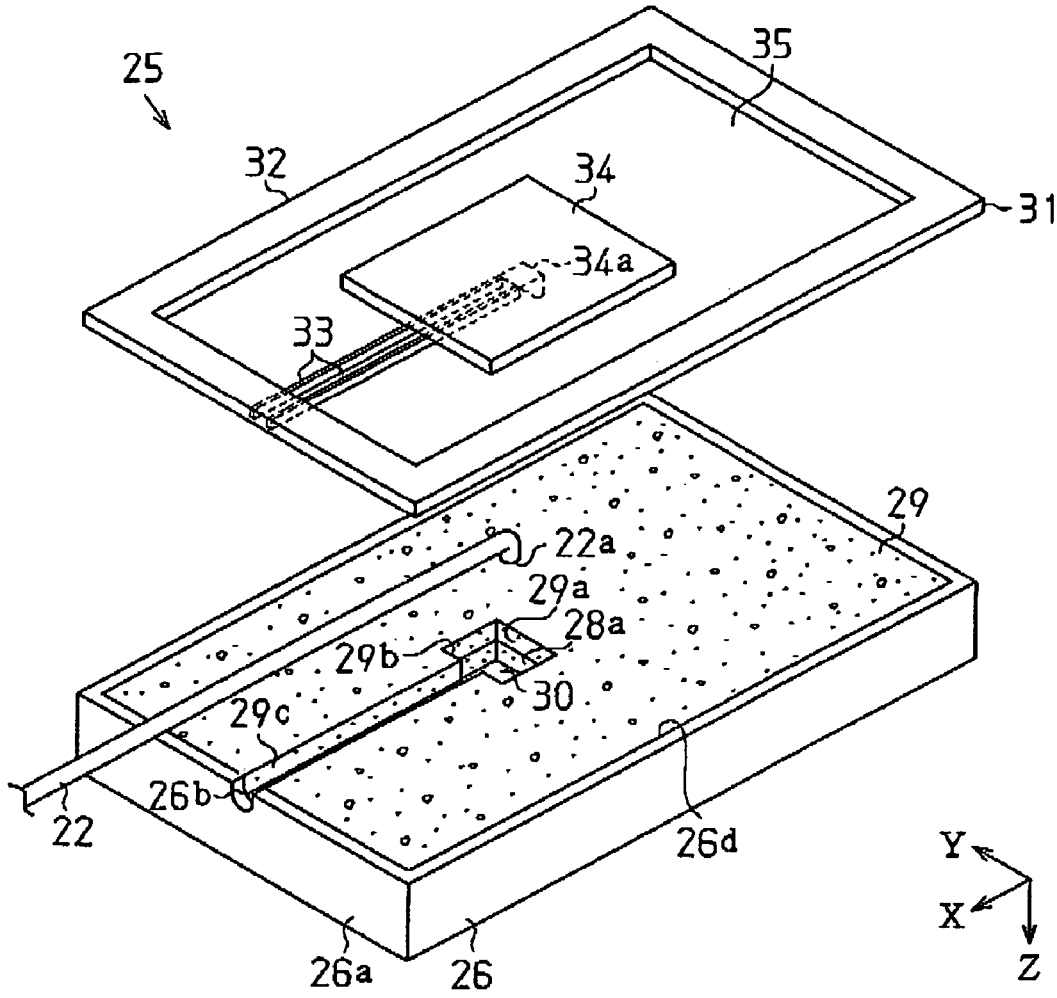
FIG. 4 is another exploded perspective view showing the recovery reservoir of the first embodiment.

As shown in FIG. 3, the recovery reservoir 25 includes a container 26 serving as a container body. The container 26 is shaped as a box having an upper opening 26*d*, referring to the drawing. A substantially parallelepiped recovery space S is defined in the container 26. The container 26 includes a left side wall 26*a* forming a circumferential wall portion (as viewed to the right in FIG. 2). As shown in FIGS. 3 and 4, an insertion hole 26*b* is defined in the left side wall 26*a*. The insertion hole 26*b* is provided by removing an upper middle portion of the left side wall 26*a* in such a manner that the insertion hole 26*b* has a semi-circular cross-sectional shape.

Referring to FIG. 2, the recovery space S accommodates a first ink absorption body 27, a second ink absorption body 28, and a third ink absorption body 29 in this order from the side corresponding to a bottom surface 26*c* of the container 26. The first to third ink absorption bodies 27 to 29 are formed by equally sized sheet-like porous members. More specifically, the size of each of the ink absorption bodies 27 to 29 is substantially equal to the size of the bottom surface 26*c*, as viewed from above.

As shown in FIG. 2, the first ink absorption body 27 is arranged on the bottom surface 26*c* with the second ink absorption body 28 disposed on the first ink absorption body 27. Referring to FIG. 3, a through hole 28*a* extends through a middle portion of the second ink absorption body 28. The through hole 28*a* has a square shape, as viewed from above, and extends from the upper surface to the lower surface of the second ink absorption body 28.

Referring to FIG. 2, the third ink absorption body 29 is provided on the second ink absorption body 28. In this state, the third ink absorption body 29 has an upper surface flush with an upper end of the container 26. As shown in FIG. 3, a guide hole 29*a* extends through a middle portion of the third ink absorption body 29 at a position opposed to the through hole 28*a*. The guide hole 29*a* has the same size as the through hole 28*a*, and extends from the upper surface to the lower surface of the third ink absorption body 29. As shown in FIGS. 3 and 4, a slit 29*c* is defined in a left side wall 29*b* of the guide hole 29*a* (as viewed to the right in the guide hole 29*a* of FIG. 2). The slit 29*c* is defined by removing an intermediate portion of the left side wall 29*b* entirely along vertical direction Z and lateral direction x, so that the slit 29*c* extends from the guide hole 29*a* to the insertion hole 26*b*.

Accordingly, as shown in FIG. 4, by arranging the second and third ink absorption bodies 28, 29 in such a manner that the position of the through hole 28*a* coincides with the position of the guide hole 29*a*, an introduction chamber 30 is defined in the recovery reservoir 25. More specifically, the introduction chamber 30 is defined by a parallelepiped space located at the middle of the recovery space S. The introduction chamber 30 communicates with the insertion hole 26*b* through the slit 29*c*.

As shown in FIG. 2, a lid 31 serving as a cover member is provided on the third ink absorption body 29. Referring to FIG. 3, the lid 31 includes a frame 32, a pair of guide plates 33, and a shutter plate 34.

Referring to FIG. 3, the frame 32 has a square shape as viewed from above. The outer circumference of the frame 32 is substantially equal to the outer circumference of the upper end of the container 26. The guide plates 33 are secured to a lower surface 32*a* of the frame 32. Each of the guide plates 33 extends from the insertion hole 26*b* to the middle of the frame 32. The guide plates 33 are spaced from each other at a certain interval in front-rear direction Y, as opposed to the slit 29*c*.

As shown in FIG. 3, the shutter plate 34 serving as a shutter portion is secured to a distal upper portion of each of the guide plates 33. The shutter plate 34 is formed by a square plate member as viewed from above. The outer circumference of the shutter plate 34 is larger than the outer circumference of the upper end of the introduction chamber 30 but smaller than the inner circumference of the frame 32. In other words, a surface of the shutter plate 34 opposed to the upper surface of the third ink absorption body 29 is sized smaller than the upper surface of the third ink absorption body 29. As shown in FIG. 4, a guide piece 34*a* is secured to the lower surface of the shutter plate 34. More specifically, the guide piece 34*a* is formed by a substantially triangular projection. The side surface of the guide piece 34*a* opposed to the distal ends of the guide plates 33 is slanted downwardly from the lower surface of the shutter plate 34 toward the middle of the introduction chamber 30.

That is, the shutter plate 34 is arranged in the space defined by the frame 32 of the lid 31, by means of the guide plates 33. In this manner, a square frame-shaped communication hole 35 is defined in vertical direction Z and between the outer circumferential surface of the shutter plate 34 and the inner circumferential surface of the frame 32.

With the lid 31 (the frame 32) secured to the upper end of the container 26 of the recovery reservoir 25, the shutter plate 34 covers an upper side of the introduction chamber 30 opposed to the shutter plate 34 and an upper surface section of the third ink absorption body 29 in the vicinity of the introduction chamber 30. Further, in the recovery reservoir 25, the upper surface of the third ink absorption body 29 facing the communication hole 35 is exposed to the exterior of the container 26 through the communication hole 35.

As shown in FIG. 2, the guide plates 33 are received in the slit 29*c*, and a guide passage 36 is thus defined by the guide plates 33, the guide piece 34*a*, and the second ink absorption body 28. The discharge tube 22 is then inserted into the recovery space S as guided by the guide passage 36, as shown in the drawing, and a distal end of the discharge tube 22 is bent in correspondence with the shape of the guide piece 34*a*. In this manner, a discharge port 22*a* is defined at a position opposed to the middle of the first ink absorption body 27.

In this state, if the suction pump 23 is actuated and cleaning is started, the waste ink is discharged from the suction pump 23 and introduced into the introduction chamber 30 through the discharge tube 22 (the guide passage 36). Since the upper side of the introduction chamber 30 is covered by the shutter plate 34 as has been described, volatilization of the solvent element of the ink in the introduction chamber 30 is suppressed by a corresponding quantity. This delays solidification of the diffusion element correspondingly, removing the bubbles from the waste ink. The waste ink is then absorbed by the first ink absorption body 27, which corresponds to the bottom surface of the introduction chamber 30.

The waste ink then diffuses isotropically from the middle of the first ink absorption body 27, or the bottom surface of the introduction chamber 30, and moves along the bottom surface 26*c*. Some of the waste ink diffusing in the first ink absorption body 27 eventually reaches the second and third ink absorption bodies 28, 29, which are located above the first ink absorption body 27, by capillarity. That is, the waste ink diffuses from the introduction chamber 30 to the first ink absorption body 27 and then to the second ink absorption body 28, and is eventually absorbed and recovered by the third ink absorption body 29.

In the third ink absorption body 29, some solvent element of the waste ink volatilizes to the exterior of the recovery reservoir 25 through the communication hole 35. This reduces the quantity of the waste ink in the third ink absorption body 29 correspondingly. The third ink absorption body 29 is thus allowed to further absorb the ink from the first or second ink absorption body 27, 28.

The first embodiment has the following advantages.

(1) In the first embodiment, the introduction chamber 30 is defined by the first, second, and third ink absorption bodies 27, 28, 29. The discharge port 22*a* of the discharge tube 22 is defined in the introduction chamber 30. The upper side of the introduction chamber 30 is covered by the shutter plate 34. The shutter plate 34 thus suppresses volatilization of the solvent element of the waste ink, which is discharged from the discharge port 22*a* to the introduction chamber 30. Therefore, solidification of the diffusion element of the ink in the introduction chamber 30 is delayed, which allows the bubbles to be removed from the waste ink. Accordingly, the waste ink in the introduction chamber 30 is absorbed smoothly by the first ink absorption body 27 and permeates a wide range of the first ink absorption body 27, without excessively increasing viscosity and solidifying.

(2) In the first embodiment, the lid 31 is arranged along the upper end of the container 26 and the communication hole 35 of the lid 31 is defined above the third ink absorption body 29. The solvent element of the waste ink absorbed by the third ink absorption body 29 thus volatilizes from the communication hole 35. This decreases the quantity of the ink retained in the third ink absorption body 29, thus correspondingly increasing the absorption capacity of the third ink absorption body 29 for the waste ink in the first and second ink absorption bodies 27, 28. The absorption efficiency of each of the ink absorption bodies 27, 28, 29 is thus improved.

(3) In the first embodiment, the upper side of the third ink absorption body 29 is covered by the frame 32 and the shutter plate 34. Therefore, if the recovery reservoir 25 is displaced due to vibration, the areas of the third ink absorption body 29 covered by the frame 32 and the shutter plate 34 prevent the waste ink from leaking from the upper side of the third ink absorption body 29.

(4) In the first embodiment, the lid 31 includes the guide plates 33 and the guide piece 34*a*. The discharge port 22*a* of the discharge tube 22 is faced to the middle of the first ink absorption body 27. The ink discharged from the discharge port 22*a* is thus absorbed by the first ink absorption body 27 isotropically from the middle of the first ink absorption body 27. Accordingly, unlike a case in which the ink is absorbed from an end of the first ink absorption body 27, for example, the waste ink diffuses in the first ink absorption body 27 in multiple directions. The absorption efficiency of the first ink absorption body 27 is thus improved.

A second embodiment of the present invention will hereafter be explained. The following description focuses on the difference between the second embodiment and the first embodiment.

Figure 5:
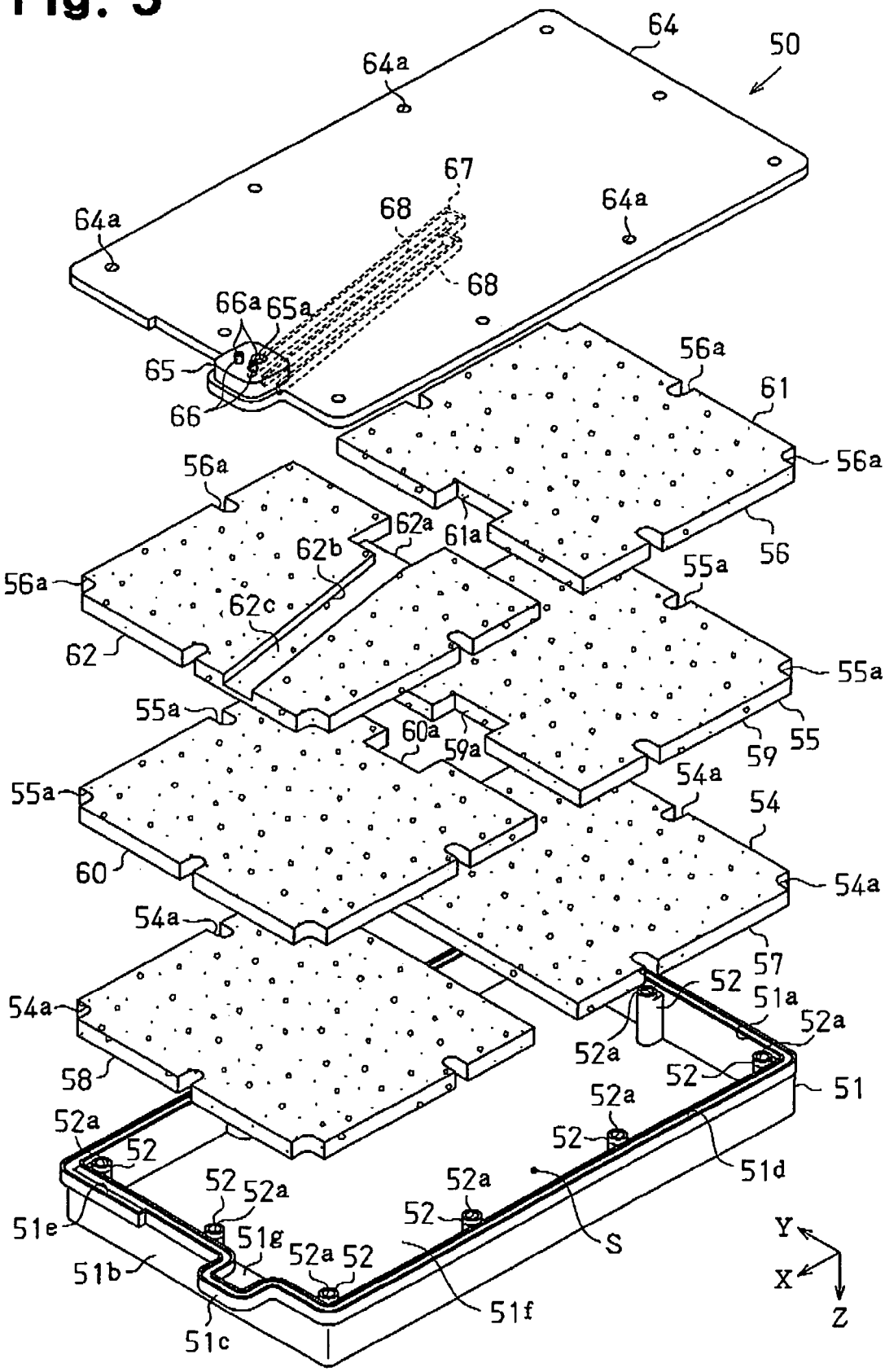
FIG. 5 is an exploded perspective view showing a recovery reservoir according to a second embodiment of the present invention.
Figure 6:
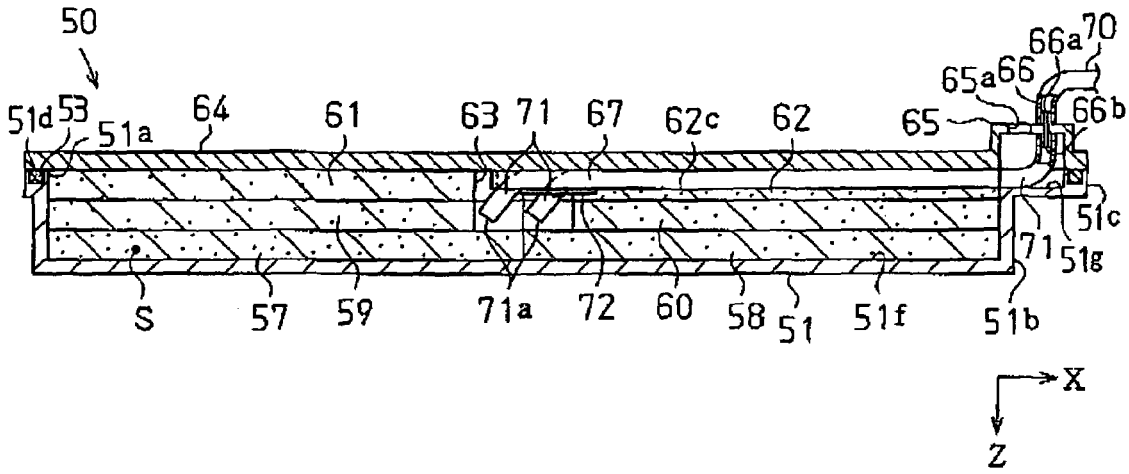
FIG. 6 is a cross-sectional view showing a recovery reservoir of the second embodiment.

In the second embodiment, as shown in FIGS. 5 and 6, a recovery reservoir 50 serving as a liquid recovery container defining a recovery means includes a container 51 serving as a container body. The container 51 is shaped like a rectangular box having an upper opening and a recovery space S is defined in the container 51 for recovering ink, which is liquid. A plurality of (in this embodiment, ten) ribs 52 project inwardly from the inner side surfaces of the container 51. A thread groove 52*a* is defined in an upper surface of each of the ribs 52.

A projection piece 51*c* projects in a horizontal direction outwardly from a portion of an upper end of a left side wall 51*b* (right side wall as viewed in FIG. 6) of the container 51. An annular accommodation groove 51*d*, which serves as a positioning means, is defined around the opening 51*a* of the container 51 and extends entirely along the upper end (the entire upper surface) of the container 51. A portion of the accommodation groove 51*d* corresponding to the projection piece 51*c* is bent outwardly in correspondence with the outer circumference of the projection piece 51*c*. A wide groove section 51*e* is formed in a longitudinal portion of the accommodation groove 51*d* (in the second embodiment, a portion of the upper end of the left side wall 51*b* of the container 51) and has a width twice as large as the width of the remaining portion of the accommodation groove 51*d* (see FIGS. 7 and 8).

Figure 7:
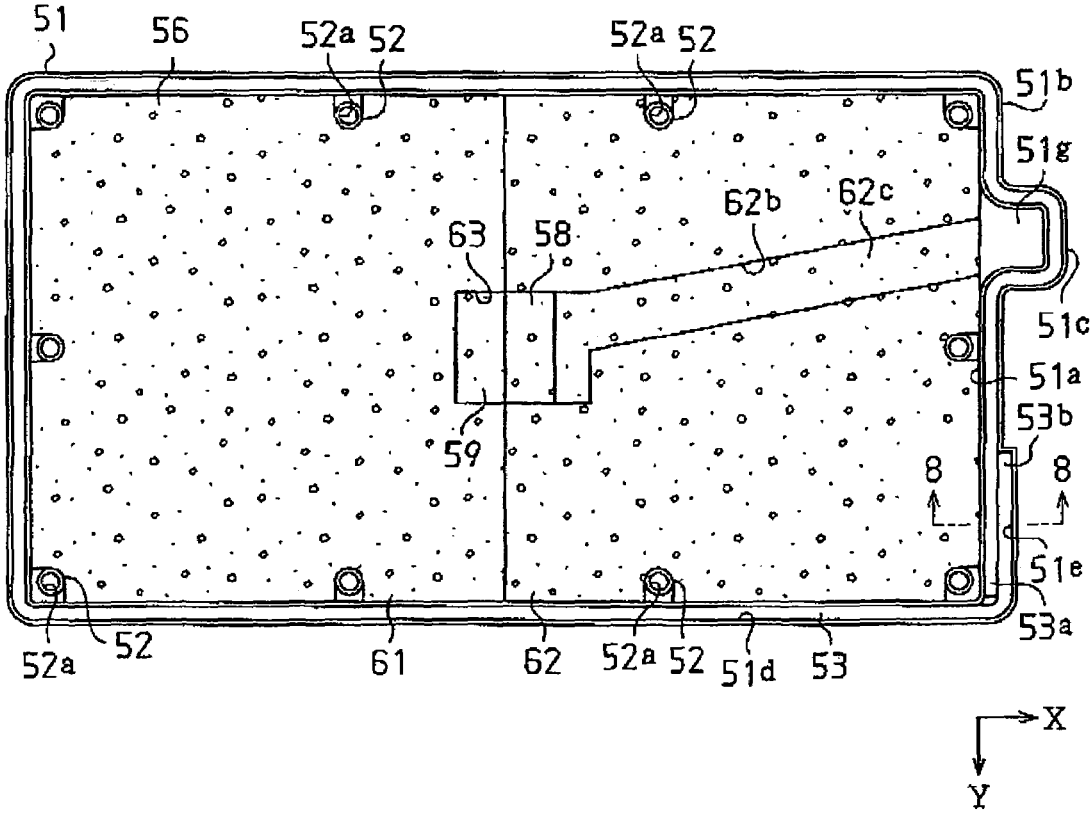
FIG. 7 is a plan view showing the recovery reservoir of the second embodiment with a lid removed therefrom.
Figure 8:
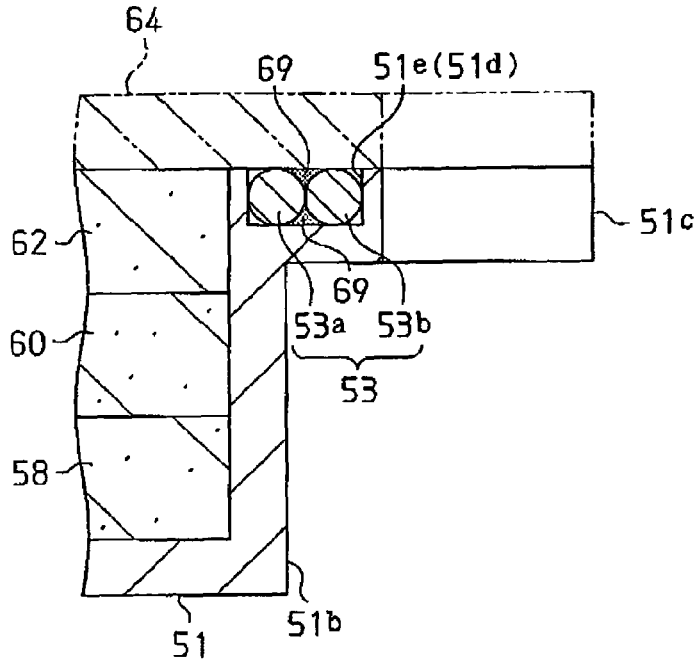
FIG. 8 is a cross-sectional view taken along line 8-8 of FIG. 7.

As shown in FIGS. 7 and 8, the accommodation groove 51*d* accommodates an elongated seal member 53, which is formed of flexible material and has a substantially circular cross-sectional shape. The seal member 53 is arranged along the upper end of the container 51 in such a manner to encompass the opening 51*a* of the container 51. Two opposing ends 53*a*, 53*b* of the seal member 53 are joined together. More specifically, the longitudinal ends 53*a*, 53*b* of the seal member 53 are arranged in parallel with each other while overlapping each other longitudinally in the wide groove section 51*e*, which is defined in a portion of the accommodation groove 51*d*. In this state, the ends 53*a*, 53*b* are joined together by a seal material 69, which is formed of butyl rubber and fitted in the wide groove section 51*e*, in such a manner that the seal member 53 forms an annular shape.

The recovery space S receives first, second, and third ink absorption bodies 54, 55, 56 each having a rectangular plate-like shape and serving as a liquid absorption body. The first to third ink absorption bodies 54 to 56 are stacked together in this order from the side corresponding to a bottom surface 51*f* of the container 51. Like the ink absorption bodies 27, 28, 29 of the first embodiment, the ink absorption bodies 54, 55, 56 are formed by equally sized sheet-like porous members. The size of each ink absorption body 54 to 56 is substantially equal to the size of the bottom surface 51*f*, as viewed from above. Notches 54*a*, 55*a*, 56*a* are defined in the outer circumferences of the ink absorption bodies 54, 55, 56, respectively, at positions corresponding to the ribs 52. The shape of each of the notches 54*a*, 55*a*, 56*a* matches the shape of the corresponding rib 52. When the notches 54*a*, 55*a*, 56*a* are engaged with the corresponding ribs 52, the ink absorption bodies 54, 55, 56 are positioned with respect to the recovery space S.

Each of the ink absorption bodies 54 to 56 is divided into two sections at the longitudinal middle of the ink absorption body 54 to 56 along a lateral direction of the ink absorption body 54 to 56. In other words, the first ink absorption body 54 is divided into a first section 57 and a second section 58. The second ink absorption body 55 is divided into a third section 59 and a fourth section 60. The third ink absorption body 56 is divided into a fifth section 61 and a sixth section 62.

A cutout 59*a* is defined in the interface of the third section 59 of the second ink absorption body 55 with respect to the fourth section 60. A cutout 60*a* is defined in the interface of the fourth section 60 of the second ink absorption body 55 with respect to the third section 59. The cutouts 59*a*, 60*a* are opposed to each other. Similarly, a cutout 61*a* is defined in the interface of the fifth section 61 of the third ink absorption body 56 with respect to the sixth section 62. A cutout 62*a* is defined in the interface of the sixth section 62 of the third ink absorption body 56 with respect to the fifth section 61. The cutouts 61*a*, 62*a* are opposed to each other. The position of the cutout 59*a* corresponds to the position of the cutout 61*a* in a vertical direction, and the position of the cutout 60*a* corresponds to the position of the cutout 62*a* in a vertical direction. When the ink absorption bodies 54 to 56 are stacked together in the recovery space S, a space surrounded by the upper side of the first ink absorption body 54 and the cutouts 59*a*, 60*a*, 61*a*, 62*a* is defined in the middle of the container 51 as an introduction chamber 63.

A groove 62*b* having a rectangular cross-sectional shape is defined in the upper side of the sixth section 62, which forms the third ink absorption body 56 together with the fifth section 61. The groove 62*b* extends linearly from the introduction chamber 63 to the projection piece 51*c*. A bottom surface 62*c* of the groove 62*b* is flush with an upper surface 51*g* of the projection piece 51*c* (a portion of the upper end (the upper surface) of the left side wall 51*b* of the container 51 located inwardly from the bent section of the accommodation groove 51*d*).

As shown in FIGS. 5 and 6, a rectangular plate-like lid 64 serving as a cover member is arranged above the third ink absorption body 56. The size of the lid 64 is substantially equal to the size of the bottom surface 51*f*, as viewed from above. The surface of the lid 64 opposed to the upper side of the third ink absorption body 56 is formed larger than the upper surface of the third ink absorption body 56. A plurality of insertion holes 64*a* extend through an outer circumferential portion of the lid 64 at positions corresponding to the ribs 52 (the thread grooves 52*a*). A plurality of non-illustrated screws are fastened to the thread grooves 52*a* through the insertion holes 64*a*, thus securing the lid 64 to the container 51 in a manner covering the opening 51*a* entirely. In this state, the seal member 53 is arranged between the lid 64 and the container 51 and improves the seal performance of the container 51.

As shown in FIGS. 5 and 6, a projection 65 projects from the lid 64 and has a shape matching the shape of the projection piece 51*c*, as viewed from above. With the lid 64 secured to the container 51 while sealing the opening 51*a*, the projection 65 covers the projection piece 51*c* from above and defines a gap between the projection 65 and the upper surface 51*g* of the projection piece 51*c*.

A communication hole 65*a* extends through a proximal portion of the projection 65. A pair of cylindrical tube connector portions 66 are formed in a distal portion of the projection 65 located outwardly from the communication hole 65*a*, as arranged in parallel in front-rear direction Y. Each of the tube connector portions 66 extends in vertical direction Z and includes an upper projection 66*a* and a lower projection 66*b*. The upper projection 66*a* projects upward from the upper surface of the projection 65 and the lower projection 66*b* projects downward from the lower surface of the projection 65. The upper projection 66*a* and the lower projection 66*b* communicate with each other, thus forming the corresponding one of the tube connector portions 66.

A guide plate 67 is formed along the lower surface of the lid 64 and extends from the projection 65 to the middle of the lid 64. The guide plate 67 is received in the groove 62*b* of the third ink absorption body 56 when the lid 64 is secured to the container 51 in a manner sealing the opening 51*a*. The guide plate 67 has two guide passages 68 extending parallel with each other in a longitudinal direction of the guide plate 67. The length of an end portion of one of the guide passages 68 at the side corresponding to the introduction chamber 63 (the middle of the lid 64) is different from the length of a corresponding end portion of the other (or, in other words, the end portion of one of the guide passages 68 is shorter than the end portion of the other guide passage 68).

In the second embodiment, two flexible discharge tubes 70, which extend from the suction pump 23, are each connected to a corresponding one of the upper projections 66*a* projecting from the upper surface of the projection 65, as shown in FIG. 6. Further, proximal ends of two flexible discharge tubes 71, which are provided separately from the discharge tubes 70, are each connected to a corresponding one of the lower projections 66*b* projecting from the lower surface of the projection 65. The discharge tubes 71 extend to the interior of the introduction chamber 63 substantially horizontally along the corresponding guide passages 68 of the guide plate 67 at the lower surface of the lid 64. The distal end of each discharge tube 71 is bent in a manner slanted downwardly in the introduction chamber 63.

Figure 9:
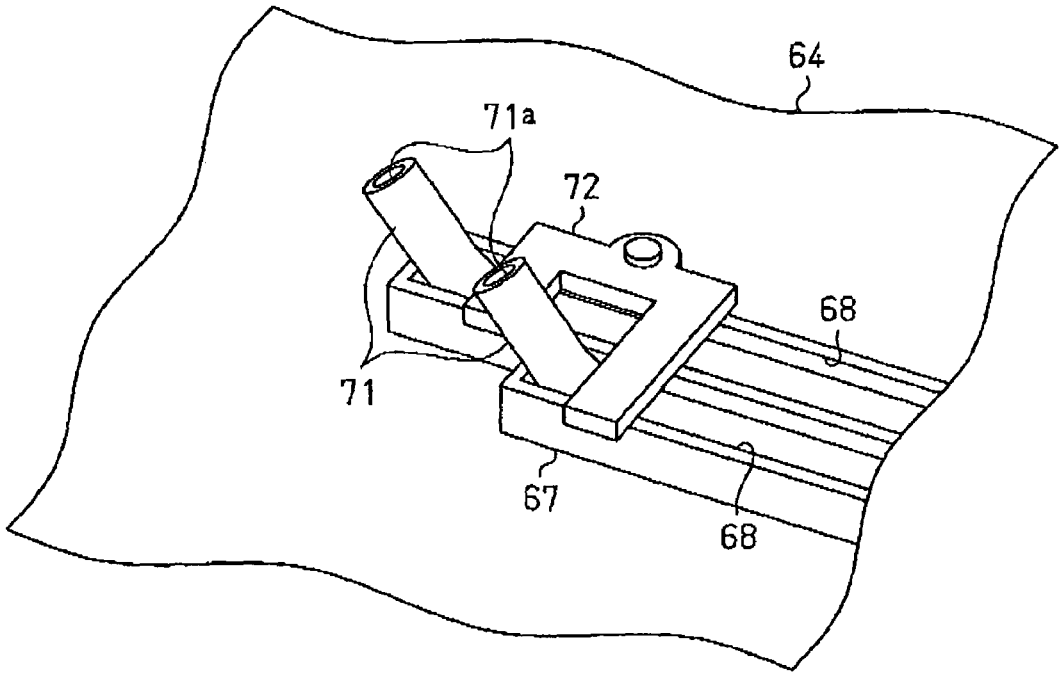
FIG. 9 is a perspective view showing a main portion of a lower surface of the lid of the recovery reservoir of the second embodiment.

As shown in FIG. 9, the bent distal end of each discharge tube 71 is secured to a wall of the corresponding guide passage 68 by a substantially U-shaped support member 72, thus supporting the discharge tubes 71 with respect to the lower side of the lid 64. The discharge tubes 71 are arranged in such a manner that two discharge ports 71*a*, each of which is defined by the distal end of the corresponding discharge tube 71, are located at offset positions with respect to each other in lateral direction X, in the introduction chambers 63. That is, in the second embodiment, the discharge ports 71*a* of the discharge tubes 71 are located in the middle of the recovery reservoir 50 and the communication hole 65*a* is defined at an end of the recovery reservoir 50 (or, more specifically, in the projection 65 covering the upper side of the projection piece 51*c*). More specifically, the communication hole 65*a* is defined at a position (immediately above the upper surface 51*g* of the projection piece 51*c*) horizontally spaced from a portion of the lid 64 immediately above the discharge ports 71*a* (the vicinity of the introduction chamber 63). In other words, the communication hole 65*a* is located at an end of the lid 64 outside the area opposed to the third ink absorption body 56.

When the suction pump 23 is actuated for starting cleaning, the suction pump 23 discharges the waste ink into the introduction chamber 63 through the discharge tubes 70, 71 (the guide passages 68). Like the first embodiment, the waste ink in the introduction chamber 63 diffuses from the first ink absorption body 54 to the second ink absorption body 55 and then to the third ink absorption body 56. The waste ink is thus recovered by the container 51. In the second embodiment, since the opening 51*a* of the container 51 is entirely covered by the lid 64 and the communication hole 65*a* is located at the above-described position, the volatile element of the waste ink volatilizing from the first to third ink absorption bodies 54 to 56 is temporarily retained in the recovery space S. Thus, when the amount of the recovered waste ink exceeds a predetermined level, the recovery space S is filled, or moisturized, with the vapor of the volatile element. This suppresses volatilization of the solvent element of the waste ink from the first to third ink absorption bodies 54 to 56. The ink absorption bodies 54 to 56 are thus maintained in a moist state without fully solidifying. Therefore, for example, if the ink contains a relatively great content of pigment or has relatively high viscosity or if the porous material of the ink absorption bodies 54 to 56 exhibits relatively low affinity (permeability) to a particular type of ink, the solvent element of the waste ink in the introduction chamber 63 is prevented from volatilizing and solidifying before the ink is absorbed by the ink absorption bodies 54 to 56.

Further, by maintaining each ink absorption body 54 to 56 in a moist state, the pores of the ink absorption body 54 to 56 are prevented from being clogged by, for example, a condense of the pigment. Also, even if the ink contains a relatively great content of pigment, the waste ink is allowed to rapidly permeate the ink absorption bodies 54 to 56 by maintaining the waste ink in the ink absorption bodies 54 to 56 in a liquid state, thus lowering the interface tension of the ink on the bottom surface of the introduction chamber 63. This allows the waste ink to smoothly permeate the entire portions of the first to third ink absorption bodies 54 to 56, when introduced into the introduction chamber 63.

Further, the recovery space S is also maintained in a moist state, thus suppressing volatilization of the solvent element from a small amount of ink residue or bubbles of the waste ink, which may be accumulated in the introduction chamber 63. The waste ink is thus prevented from fully solidifying. The residue and the bubbles are then removed by the waste ink later introduced into the introduction chamber 63.

Also, if the recovery space S is saturated with the released solvent element of the waste ink, the solvent element in a volatilized state is sent to the communication hole 65*a* through a small space between the upper surface of the third ink absorption body 56 and the lower surface of the lid 64. The solvent element is then discharged from the recovery reservoir 50 to the exterior via the communication hole 65*a*. In the second embodiment, the communication hole 65*a* is located not at a position immediately above the discharge ports 71*a* but at a position horizontally spaced from the discharge ports 71*a* (a position corresponding to the projection 65). This arrangement suppresses excessive volatilization of the waste ink from the communication hole 65*a*, after the ink is discharged from the discharge ports 71*a*. Further, since the communication hole 65*a* is not defined immediately above the third ink absorption body 56, the third ink absorption body 56 is prevented from focally drying, and the third ink absorption body 56 as a whole is maintained in a substantially uniformly moist state.

The inner diameter of the communication hole 65*a* is set in correspondence with the pigment content of the waste ink and the vapor pressure of the solvent element, in such a manner that the recovery space S is held in an appropriately moist state so that the waste ink does not solidify. The humidity of the recovery space S is thus maintained at a level at which the pigment of the waste ink is free from condensation and solidification and permeability of the waste ink is maintained. Also, if the amount of the volatile element (the volatilized solvent element) in the recovery space S becomes excessively great, the volatile element is discharged to the exterior through the communication hole 65*a*. The amount of the waste ink recovered by the recovery reservoir 50 is thus increased by an amount corresponding to the discharged amount of the volatile element.

The seal member 53 between the lid 64 and the container 51 improves the seal performance of the container 51. This suppresses volatilization or leakage of the waste ink from the gap between the lid 64 and the container 51. When installing the seal member 53 between the lid 64 and the container 51, the seal member 53 is positioned effectively by the accommodation groove 51*d*, which is defined in the upper end of the container 51. If the size of the recovery reservoir 50 is (the sizes of the container 51 and the lid 64 are changed, the length of the seal member 53, which is formed by a single elongated seal member, is changed to a value sufficiently large for encompassing the opening 51*a* of the container 51.

The second embodiment has the following advantages.

(5) The lid 64 covers the opening 51*a* of the container 51 entirely and thus suppresses volatilization of the waste ink, which has been discharged from the discharge ports 71*a* and absorbed by the ink absorption bodies 54 to 56, through the opening 51*a*. This maintains the recovery space S in a moist state, suppressing solidification of the diffusion element of the waste ink in the ink absorption bodies 54 to 56 or the waste ink in the introduction chamber 63. In other words, the volatilization amount of the solvent element is decreased by increasing the covered area of the opening 51*a* compared to the first embodiment. This configuration is particularly effective if the ink contains a relatively great content of pigment or exhibits relatively high viscosity, making it likely for the pores of each ink absorption body 54 to 56 to be clogged or an ink residue to form. Contrastingly, by allowing some of the waste ink absorbed by the ink absorption bodies 54 to 56 to volatilize through the communication hole 65*a* defined in the lid 64, the absorption efficiency of each ink absorption body 54 to 56 is improved. The recovery reservoir 50 can thus be reduced in size. Further, by changing the size of the communication hole 65*a* in correspondence with the type of the ink absorbed by the ink absorption bodies 54 to 56, the waste ink is allowed to volatilize through the communication hole 65*a* efficiently.

(6) Since the communication hole 65*a* is spaced from the discharge ports 71*a*, the waste ink does not volatilize from the communication hole 65*a* immediately after having been discharged from the discharge ports 71*a*. This suppresses excessive volatilization of the waste ink from the ink absorption bodies 54 to 56 through the communication hole 65*a*.

(7) The seal member 53 improves the seal performance between the container 51 and the lid 64. The waste ink is thus effectively prevented from volatilizing or leaking from the gap between the container 51 and the lid 64.

(8) When installing the seal member 53 between the container 51 and the lid 64, the seal member 53 is positioned by means of the accommodation groove 51*d* defined in the container 51. This facilitates the installation of the seal member 53.

(9) The original shape of the seal member 53 is not annular but elongated. Thus, even for differently sized containers 51 and differently sized lids 64, it is unnecessary to prepare a plurality of differently sized annular seal members 53 in correspondence with the sizes of the containers 51 and the sizes of the lids 64. Further, since the length of the seal member 53 is easily adjustable, the seal member 53 is rapidly modified in correspondence with the sizes of the containers 51 and the sizes of lids 64.

(10) The seal material 69 is provided in the gap between the opposing ends 53*a*, 53*b* in the longitudinal direction of the seal member 53, with the ends 53*a*, 53*b* arranged in parallel. The seal performance of the seal material 69 is thus equivalent to the seal performance of an annular seal member.

(11) In the recovery reservoir 50, the opening 51*a* of the container 51 is covered entirely by the lid 64. The rigidity of the recovery reservoir 50 is thus higher than the rigidity of the recovery reservoir 25 of the first embodiment.

Figure 10:
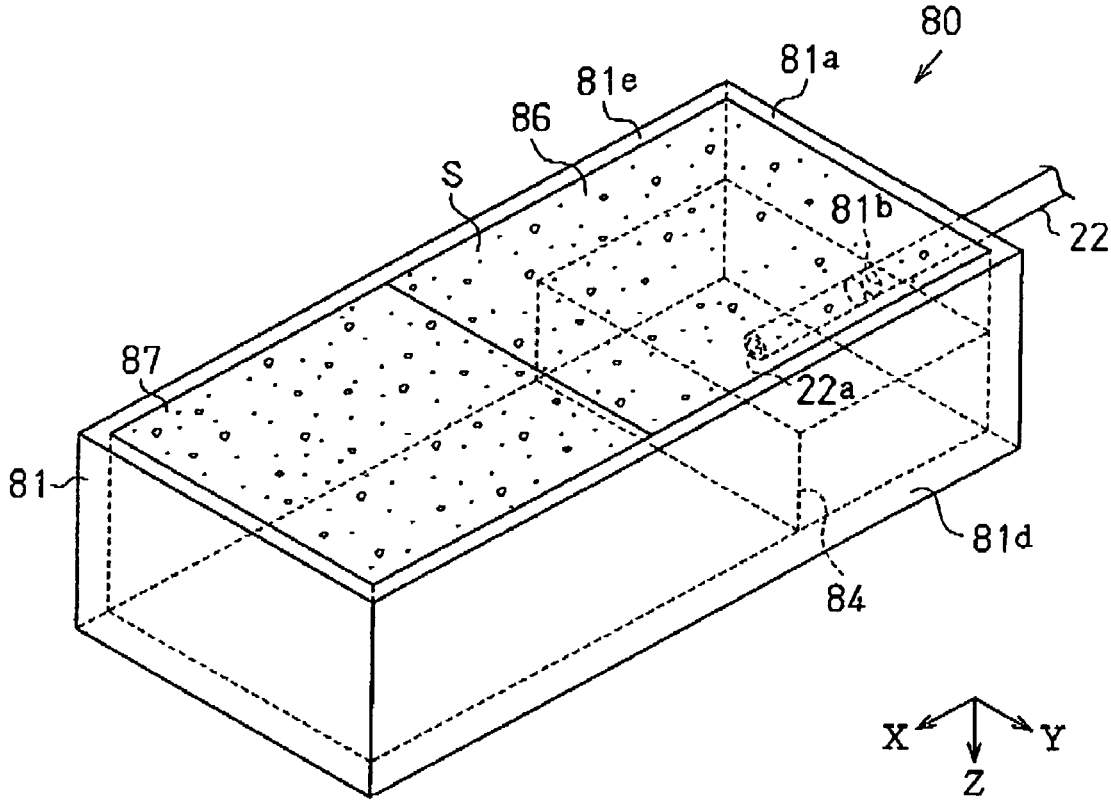
FIG. 10 is a perspective view showing a recovery reservoir according to a third embodiment of the present invention.
Figure 11:
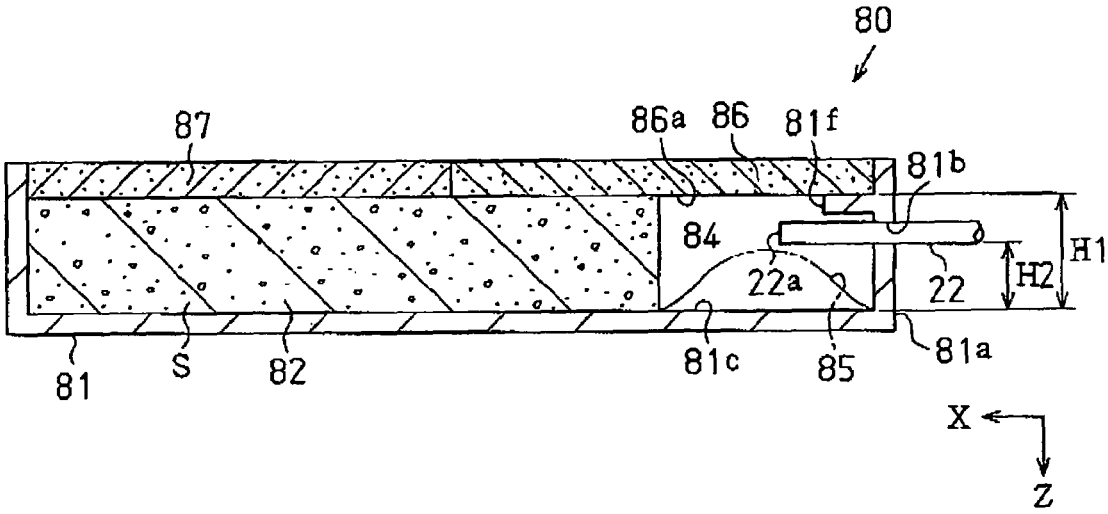
FIG. 11 is a front cross-sectional view showing a recovery reservoir according to a third embodiment of the present invention.

A recovery reservoir according to a third embodiment of the present invention will be explained with reference to FIGS. 10 and 11, focusing on the difference between the first embodiment and the third embodiment. FIG. 10 is a perspective view showing a recovery reservoir 80 serving as a liquid recovery container, which defines a recovery means. FIG. 11 is a front cross-sectional view showing the recovery reservoir 80.

As shown in FIG. 10, the recovery reservoir 80 includes a container 81 serving as a container body. The recovery container 81 has a box-like shape having an upper opening. The recovery space S is defined in the recovery container 81. An insertion hole 81*b* extends through a right side wall 81*a* of the container 81. The inner diameter of the insertion hole 81*b* is substantially equal to the outer diameter of the discharge tube 22 connected to the cap 21.

As shown in FIG. 11, the recovery space S accommodates a first ink absorption body 82 serving as a liquid absorption body. The first ink absorption body 82 is formed of porous material permeable to the waste ink. The length of the first ink absorption body 82 in a direction defined by a width of the ink absorption body 82 (a dimension in lateral direction X) is smaller than the length of the recovery space S defined by a width of the recovery space S (a dimension in lateral direction X). The height of the first ink absorption body 82 (a dimension in a direction opposed to vertical direction Z) is smaller than the height of the recovery space S. The depth of the first ink absorption body 82 (a dimension in front-rear direction Y) is equal to the depth of the recovery space S.

A maximum ink absorption capacity of the first ink absorption body 82 is set in correspondence with the total volume of the pores of the first ink absorption body 82. More specifically, if the amount of the ink discharged through a single cycle of cleaning is defined as a unit ink discharge amount, the maximum ink absorption capacity of the first ink absorption body 82 corresponds to 50 unit ink discharge amounts. The maximum ink absorption capacity of the first ink absorption body 82 thus corresponds to the total volume of the waste ink discharged through fifty cycles of cleaning. Further, the volatilization rate of the waste ink in the first ink absorption body 82 is 50 percent, or, the amount of the waste ink recovered by the first ink absorption body 82 is reduced in half by the first ink absorption body 82. Therefore, the recovery reservoir 80 reaches a saturated state when 100 cycles of cleaning is completed (the number "100" is defined as the number of the saturation level cleaning cycle).

The first ink absorption body 82 is installed in the recovery space S in a state extending along the inner surfaces of the container 81 and preventing the right side wall 81*a* having the insertion hole 81*b* from being blocked. In this state, an introduction chamber 84 is defined by the first ink absorption body 82 and the inner surfaces of the container 81. The discharge tube 22 is passed through and supported by the insertion hole 81*b*, in such a manner that a discharge port 22*a* of the discharge tube 22 is located in the introduction chamber 84.

As shown in FIG. 11, an engagement projection 81*f* projects from the right side wall 81*a* at a position above the insertion hole 81*b*. The engagement projection 81*f* extends from the right side wall 81*a* to a front side wall 81*d* and a rear side wall 81*e*, which are shown in FIG. 10. In this manner, the engagement projection 81*f* is formed along the upper ends of the inner surfaces of the container 81 defining the introduction chamber 84, in a substantially U-shaped manner as viewed from above.

A second ink absorption body 86 serving as a second cover member is installed in the opening of the introduction chamber 84. The second ink absorption body 86 is formed of porous material. A half portion of the second ink absorption body 86 is supported by the upper surface of the first ink absorption body 82. The end of the second ink absorption body 86 opposed to the first ink absorption body 82 is supported by the engagement projection 81*f*, thus closing the opening of the introduction chamber 84. The second ink absorption body 86 is formed of material with a relatively small porosity rate and a relatively high density, compared to the material of the first ink absorption body 82. The size of the second ink absorption body 86 is larger than the size of the opening of the introduction chamber 84. This configuration suppresses volatilization of the solvent element of the waste ink from the introduction chamber 84 and the first ink absorption body 82.

The portion of the upper surface of the first ink absorption body 82 other than the portion covered by the second ink absorption body 86 is covered by a third ink absorption body 87 serving as a first cover member. The third ink absorption body 87 is formed of material having a density lower than that of the material of the first ink absorption body 82 and that of the material of the second ink absorption body 86.

The discharge tube 22 is arranged in the introduction chamber of height H1, which is, for example, 15 millimeters, in such a manner that interval H2 between the discharge port 22*a* of the discharge tube 22 and a bottom surface 81*c* of the container 81 of the introduction chamber 84 (the lower surface of the introduction chamber 84) is, for example, 10 millimeters. In other words, the position of the discharge port 22*a* is 2.5 millimeters offset toward the lower surface 86*a* of the second ink absorption body 86 from the intermediate position between the bottom surface 81*c* of the container 81 and the lower surface 86*a* of the second ink absorption body 86.

Interval H2 between the discharge port 22*a* and the bottom surface 81*c* is determined by multiplying the height of an ink residue deposited on the bottom surface 81*c* through a single cycle of cleaning by the number of the saturation level cleaning cycle. That is, after having been introduced into the introduction chamber 84, the waste ink diffuses along the bottom surface 81*c*. However, since the diffusion is hampered by the bubbles in the waste ink and the solvent element of the waste ink volatilizes, the viscosity of the waste ink on the bottom surface 81*c* is increased. The waste ink thus forms a bulb-like ink residue 85, as indicated by the double-dotted broken line in FIG. 11. Meanwhile, since the upper side of the introduction chamber 84 is blocked by the second ink absorption body 86, the volatilized solvent element is retained in the introduction chamber 84. This maintains the introduction chamber 84 in a relatively moist state. The solvent element of the ink residue 85 is thus prevented from volatilizing, and solidification of the ink residue 85 is suppressed. Some of the ink residue 85 is thus allowed to re-diffuse by the waste ink later discharged from the discharge port 22*a* into the introduction chamber 84.

In the third embodiment, the increase amount of the ink residue 85 toward the second ink absorption body 86 in correspondence with the quantity of the waste ink discharged into the introduction chamber 84 through a single cycle of cleaning, which is the unit ink discharge amount, is determined to be 0.1 millimeters, as corrected in correspondence with a decrease caused by the aforementioned re-diffusion of the waste ink. By multiplying the increase amount (0.1 millimeters) by the number of saturation level cleaning cycle (100), the position of the discharge port 22*a* (corresponding to interval H2) is determined to be 10 millimeters from the bottom surface 81*c* of the container 81.

In cleaning, the ink is discharged from the discharge tube 22 to the introduction chamber 84 of the recovery reservoir 80. The waste ink then diffuses along the bottom surface 81*c* outwardly in an isotropic manner. When diffusing along the bottom surface 81*c*, most of the waste ink is absorbed by the first ink absorption body 82 by capillarity of the first ink absorption body 82. However, some of the waste ink forms the ink residue 85 and is deposited on the bottom surface 81*c* of the introduction chamber 84.

Further, some of the solvent element of the waste ink volatilizes in the introduction chamber 84. Since the introduction chamber 84 is blocked by the second ink absorption body 86 having the relatively high density, the volatilized solvent element maintains the introduction chamber 84 in a relatively moist state. The bubbles in the waste ink are thus removed from the ink. Also, the area of the first ink absorption body 82 closer to the discharge port 22*a* is blocked by the second ink absorption body 86. Therefore, the waste ink is allowed to permeate the first ink absorption body 82 entirely without being interfered, after having been discharged from the discharge port 22*a*. Further, some of the solvent element absorbed by the first ink absorption body 82 volatilizes and diffuses through the pores of the first ink absorption body 82. The solvent element is then released mainly from the upper surface of the third ink absorption body 87 to the exterior. That is, the volatile element of the absorbed waste ink is released from a zone spaced from the discharge port 22*a* to the exterior.

After 75 cycles of cleaning, for example, the uppermost position of the ink residue 85 corresponds to the height of 7.5 millimeters. After 100 cleaning cycles (corresponding to the number of the saturation level cleaning cycle), the first ink absorption body 82 is completely filled with the recovered waste ink. In this state, the ink residue 85 is deposited on the bottom surface 81*c* of the container 81 by the quantity corresponding to the number of the saturation level cleaning cycle. That is, the upper most position of the ink residue 85 corresponds to the lower end of the discharge port 22*a*. In other words, even when the first ink absorption body 82 is full, the discharge port 22*a* is maintained open without being blocked by the ink residue 85, so that the ink can be discharged from the discharge port 22*a*.

The third embodiment has the following advantages.

(12) In the third embodiment, the introduction chamber 84 into which the waste ink is introduced is defined by the first ink absorption body 82 and the inner surfaces of the container 81. The discharge port 22*a* is located in the introduction chamber 84. The upper side of the introduction chamber 84 is blocked by the second ink absorption body 86 formed of the porous material having a relatively high density. This structure allows the second ink absorption body 86 to suppress volatilization of the solvent element of the waste ink in the introduction chamber 84, prevents the waste ink in the introduction chamber 84 from drying and solidifying, and removes bubbles from the waste ink. Thus, the waste ink later introduced into the introduction chamber 84 is allowed to permeate the first ink absorption body 82 smoothly. Further, drying and solidification of the ink residue 85 in the introduction chamber 84 are suppressed, making it easy for the waste ink later introduced into the introduction chamber 84 to reduce the ink residue 85. The quantity of the ink residue 85 is thus prevented from increasing. Also, the second ink absorption body 86 functions as a member for suppressing volatilization of the solvent element of the waste ink. Thus, the second ink absorption body 86 absorbs the waste ink while preventing the solvent element from volatilizing. The recovery space S is thus efficiently used. Such configuration is particularly effective in saving of the space for the recovery reservoir 80 in the printer 10. Further, even if the printer 10 is placed in an orientation in which lateral direction X of FIG. 1 corresponds to a downward direction, the second and third ink absorption bodies 86, 87 absorb the waste ink that remains in the introduction chamber 84 without being absorbed by the first ink absorption body 82. This prevents the waste ink from leaking from the printer 10 to the exterior.

(13) In the third embodiment, the upper surface of the first ink absorption body 82, which is received in the recovery space S of the container 81, is blocked by the third ink absorption body 87. This suppresses volatilization of the solvent element of the waste ink absorbed by the first ink absorption body 82. The waste ink in the first ink absorption body 82 is thus prevented from solidifying, allowing the waste ink later introduced into the introduction chamber 84 to smoothly permeate the first ink absorption body 82. Further, when the first ink absorption body 82 is saturated with the waste ink, the third ink absorption body 87 absorbs the waste ink that cannot be absorbed by the first ink absorption body 82. The recovery space S is thus efficiently used.

(14) In the third embodiment, the discharge port 22*a* of the discharge tube 22 is located in the introduction chamber 84 at a position offset from the intermediate position of the introduction chamber 84 corresponding to height H1, toward the lower surface 86*a* of the second ink absorption body 86. The position of the discharge port 22*a* is determined by multiplying a unit deposition amount of the ink residue 85, or the deposition amount of the ink residue 85 through a single cycle of cleaning, by the number of the saturation level cleaning cycle. That is, by arranging the discharge port 22*a* at the aforementioned upwardly offset position, the discharge port 22*a* is spaced from the ink residue 85, which is deposited on the bottom surface 81*c* of the container 81, by a corresponding interval. Further, since the discharge port 22*a* is located at the height corresponding to a saturation deposition amount of the ink residue 85, the discharge port 22*a* is reliably prevented from being blocked by the ink residue 85. The space for the introduction chamber 84 is thus saved in a direction corresponding to the height (a direction opposed to vertical direction Z).

The illustrated embodiments may be modified as follows.

In the first embodiment, the shutter plate 34 is formed in a square shape as viewed from above. However, the shutter plate 34 is not restricted to this shape but may be formed in any other suitable shape, for example, a cross shape as viewed from above, as long as the upper side of the introduction chamber 30 is blocked by the shutter plate 34. Further, the size of the shutter plate 34 may be larger than the size illustrated in the first embodiment. That is, the shutter plate 34 may be enlarged to a size at which the shutter plate 34 covers most of the upper surface of the third ink absorption body 29 with only a zone above the ends of the third ink absorption body 29 uncovered. In other words, by changing the area of the shutter plate 34 in accordance with the type of the used ink, the volatilization amount of the solvent element can be decreased.

In the first embodiment, the communication hole 35 has a rectangular loop shape as viewed from above. However, the shape of the communication hole 35 is not restricted to this but may be an annular shape as viewed from above. Alternatively, the communication hole 35 may be formed by multiple through holes extending through the lid 31 in vertical direction Z. That is, the communication hole 35 may have any suitable shape as long as the solvent element is allowed to volatilize from the third ink absorption body 29 through the communication hole 35.

In the first embodiment, the communication hole 35 is defined in the lid 31. However, the communication hole 35 may be omitted and the lid 31 may cover the entire upper surface of the container 26. In this case, a clearance is defined between the lid 31 and the container 26 for allowing the solvent element to volatilize from the clearance. Alternatively, the lid 31 may be configured in such a manner that the solvent element passes through the lid 31 at a predetermined rate, thus allowing the solvent element to volatilize through the lid 31.

Figure 12:
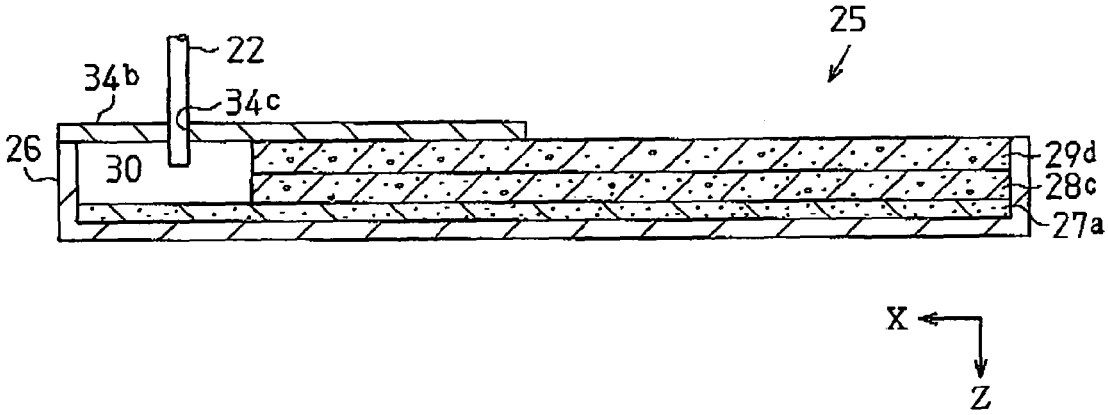
FIG. 12 is a cross-sectional view showing a fourth embodiment of the present invention.

In the first or second embodiment, the introduction chamber 30, 63 and the discharge port 22*a*, 71*a* are located at the substantial middle of the recovery space S. However, the introduction chamber 30, 63 and the discharge port 22*a*, 71*a* may be arranged at a corner of the recovery space S, or at any suitable position for discharging the waste ink into the recovery space S. In the recovery reservoir 25 of the first embodiment, for example, as shown in FIG. 12, a first ink absorption body 27*a* may be arranged on the bottom surface 26*c* of the container 26. The longitudinal dimension of a second ink absorption body 28*c* and the longitudinal dimension of a third ink absorption body 29*d*(which are measured in lateral direction X) are shorter than the longitudinal dimension of the first ink absorption body 27*a*. The introduction chamber 30 is defined by the ink absorption bodies 27*a*, 28*c*, 29*d* and the corresponding inner surfaces of the container 26. A shutter plate 34*b* is formed to a size at which the shutter plate 34*b*closes the opening of the introduction chamber 30 and blocks a portion of the first ink absorption body 27*a*. The opening of the introduction chamber 30 is thus closed by the shutter plate 34*b*. The discharge tube 22 may be passed through and supported by an insertion hole 34*c* defined in the shutter plate 34*b*, instead of being passed through the wall of the container 26. When passed through the insertion hole 34*c*, the axis of the discharge tube 22 extends vertical.

Figure 13:
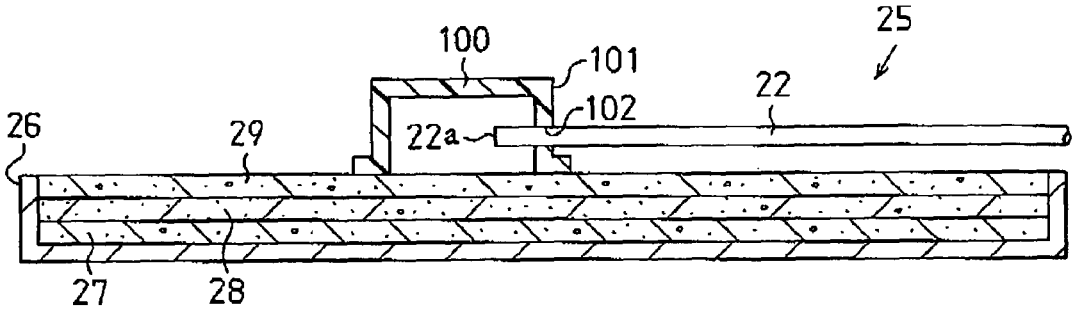
FIG. 13 is a cross-sectional view showing a modification of the recovery reservoir.

In the first embodiment, the discharge port 22*a* of the discharge tube 22 may be arranged above the ink absorption bodies. The vicinity of the discharge port 22*a* is closed by the upper surface of the ink absorption body 29 and a cover member. More specifically, as shown in FIG. 13, for example, a lidded cylindrical cover member 100 may be formed on the upper surface of the third ink absorption body 29. The cover member 100 is formed of material impermeable to vapor, such as elastomer or synthetic resin. An insertion hole 102 is defined in a side wall 101 of the cover member 100. The discharge tube 22 is passed through and supported by the cover member 100 in such a manner that the discharge port 22*a* is located in the space defined by the cover member 100. This arrangement blocks the vicinity of the discharge port 22*a* while making it unnecessary to cut the ink absorption bodies 27 to 29 and thus reduce the recovery capacity of the waste ink.

In the first embodiment, the waste ink is first absorbed by and allowed to diffuse in the first ink absorption body 27, after having been introduced into the introduction chamber 30. However, by configuring the first ink absorption body 27 identically to the second ink absorption body 28, or, by defining a through hole corresponding to the through hole 28*a* in the first ink absorption body 27, the waste ink is received by and allowed to diffuse on the bottom surface 26*c* of the container 26. The waste ink is then absorbed successively by the first, second, and third ink absorption bodies 27, 28, 29.

In the first embodiment, the liquid absorption bodies are formed by the three ink absorption bodies, the first, second, and third ink absorption bodies 27, 28, 29. However, the quantity of the liquid absorption bodies is not restricted to this. That is, the liquid absorption bodies may include a single or two, or four or more liquid absorption bodies.

In the second embodiment, the seal material 69 may be omitted. In this case, a clearance is defined between the ends 53*a*, 53*b* of the seal member 53 and functions as an auxiliary communication hole.

In the second embodiment, the ends 53*a*, 53*b* of the seal member 53 may be arranged in such a manner to oppose each other.

In the second embodiment, the ends 53*a*, 53*b* of the seal member 53 may be bonded together through welding. In this case, the seal material 69 does not necessarily have to be provided.

In the second embodiment, instead of the accommodation groove 51*d*, a projection may be formed as a positioning means. The seal member 53 is positioned using the projection.

In the second embodiment, the seal member 53 and the accommodation groove 51*d* may be omitted. In this case, it is preferred that the lid 64 is secured to the upper end of the container 51 in a state held in tight contact with the container 51.

In the second embodiment, the communication hole 65*a* and the discharge port 71*a* may not be spaced from each other. That is, the communication hole 65*a* and the discharge port 71*a* may be located close to each other. Further, two or more communication holes 65*a* may be provided.

In the second embodiment, the communication hole 65*a* may be defined immediately above the third ink absorption body 56 at a position spaced from a position immediately above the introduction chamber 63. This arrangement also suppresses excessive volatilization of the solvent element of the ink absorption bodies 54 to 56.

Figure 14:
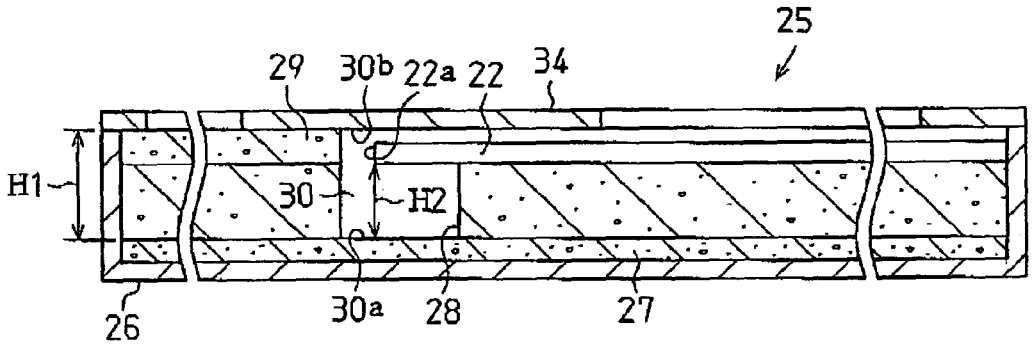
FIG. 14 is a cross-sectional view showing another modification of the recovery reservoir.

In the first or second embodiment, the discharge port 22*a*, 71*a* of the discharge tube 22, 71 may be arranged at a height offset from an intermediate position between the first ink absorption body 27, 54 and the shutter plate 34 or the lid 64, toward the shutter plate 34 or the lid 64. For example, as shown in FIG. 14, in the recovery reservoir 25 of the first embodiment, the discharge port 22*a* may be located in the introduction chamber 30, in such a manner that the uppermost point of interval H2 between the discharge port 22*a* and the bottom surface of the introduction chamber 30 (the upper surface of the first ink absorption body 27) is offset with respect to the intermediate point of height H1 of the introduction chamber 30 toward the upper side 30*b* of the introduction chamber 30. In this case, height H2 of the discharge port 22*a* may be, determined by multiplying the unit deposition amount of the ink residue formed in the introduction chamber 30 by the number of the saturation level cleaning cycle. This prevents the discharge port 22*a* from being closed by the ink residue formed in the introduction chamber 30, if any.

Figure 15:
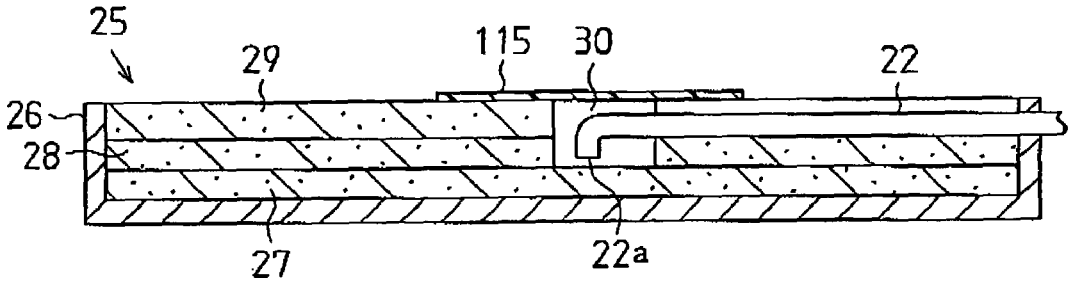
FIG. 15 is a cross-sectional view showing another modification of the recovery reservoir.

In each of the illustrated embodiments, a film or a metal plate impermeable to the solvent element may be deposited or arranged on the opening end of the recovery reservoir 25, 50, 80 for decreasing the volatilization amount of the solvent element. In this case, the shutter plate 34 and the lid 64 may be omitted. That is, for example, as shown in FIG. 15, in the recovery reservoir 25 of the first embodiment, a film 115 impermeable to the solvent element may be applied to the upper surface of the third ink absorption body 29 in such a manner to shutter the introduction chamber 30. In the second embodiment, the portion of the upper surface of the third ink absorption body 56 other than the portion corresponding to the introduction chamber 63 may be covered by the film. In the third embodiment, the second ink absorption body 86 or the third ink absorption body 87 may be replaced by the film. Alternatively, the film may be applied directly to the opening end of the container 26, 51, 81.

Figure 16:
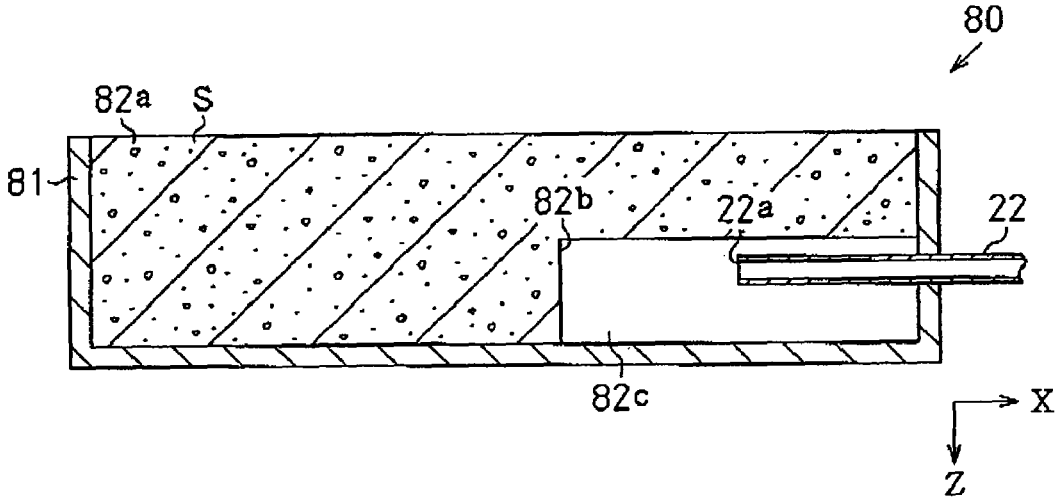
FIG. 16 is a cross-sectional view showing another modification of the recovery reservoir.

In the third embodiment, the introduction chamber 84 is covered by the second ink absorption body 86 having a relatively high density. Instead, an introduction chamber may be defined by cutting a lower portion of the first ink absorption body 82. More specifically, as shown in FIG. 16, a recess 82*b* is defined by cutting off a lower portion of an ink absorption body 82*a* received in the container 81. An introduction chamber 82*c* is thus defined by the recess 82*b* and the corresponding inner sides of the container 81. The discharge port 22*a* is arranged in the introduction chamber 82*c*. The introduction chamber 82*c* is blocked by the ink absorption body 82*a*. Thus, the discharge port 22*a* and the introduction chamber 82*c* are maintained in a moist state. Further, the configuration of the recovery reservoir 80 is simplified.

In the third embodiment, the engagement projection 81*f* projects from the container 81. However, the engagement projection 81*f* may be omitted. Also, the support member for the second ink absorption body 86 is not restricted to the substantially U-shaped projection but may be shaped in any other suitable manners. That is, the second ink absorption body 86 may be supported by multiple projections projecting from an inner side of the container 81.

In the third embodiment, the density of the material forming the second ink absorption body 86 is different from the density of the material forming the third ink absorption body 87. However, such densities may be equal. Further, the second and third ink absorption bodies 86, 87 may be formed integrally as a single component.

In the third embodiment, the introduction chamber 84 is defined in a corner of the recovery space S in the container 81 of the recovery reservoir 80. However, like the first and second embodiments, a recess may be defined in the first ink absorption body 82 for defining the introduction chamber 84 at the middle of the recovery space S.

Although the volatilization rate of the waste ink in the first ink absorption body 82 is 50 percent in the third embodiment, the volatilization rate may exceed the value. In this case, the recovery reservoir 80 is suitable for recovering the ink relatively difficult to solidify. That is, since a half or more of the waste ink is allowed to volatilize, the recovery efficiency is improved. Alternatively, the volatilization rate of the waste ink in the first ink absorption body 82 may be less than 50 percent. In this case, even if the waste ink exhibits relatively high viscosity or contains a relatively high content of pigment, the waste ink is prevented from drying and solidifying in the introduction chamber 84 and the first ink absorption body 82. The waste ink is thus allowed to permeate the entire portion of the first ink absorption body 82.

In the third embodiment, the half portion of the second ink absorption body 86 covers the first ink absorption body 82. However, the first ink absorption body 82 may be covered by the remaining portion of the second ink absorption body 86 other than the half portion.

Figure 17:
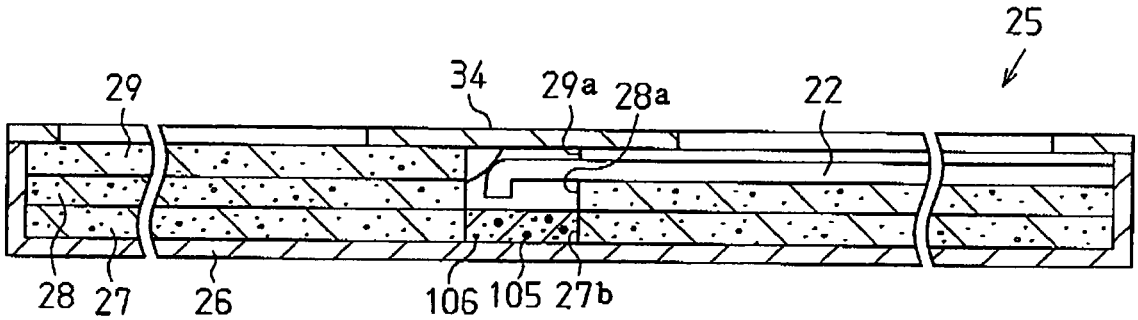
FIG. 17 is a cross-sectional view showing another modification of the recovery reservoir.

In each of the illustrated embodiments, a defoaming agent may be employed for removing the bubbles from the waste ink recovered by the recovery reservoir 25, 50, 80. For example, in the recovery reservoir 25 of the first embodiment, as shown in FIG. 17, a hole 27*b* may extend through a substantially middle portion of the first ink absorption body 27. The first to third ink absorption bodies 27 to 29 are stacked together in such a manner that the hole 27*b*, the through hole 28*a*, and the guide hole 29*a* correspond to one another. An absorption body 106 impregnated with a defoaming liquid 105 may be fitted in the hole 27*b*. The defoaming liquid 105 contains a defoaming agent such as a silicone interface activating agent or various types of regulating agents. The defoaming liquid 105 removes the bubbles from the waste ink discharged from the discharge tube 22. More specifically, if the waste ink discharged from the discharge tube 22 contains bubbles, the defoaming liquid 105, which is impregnated in the absorption body 106, adheres to the bubbles and lowers the interface tension of the bubbles, thus expanding and rupturing the bubbles. Alternatively, the defoaming liquid 105 may be applied to the inner side of the discharge tube 22. Also, the absorption body 106 including the defoaming liquid 105 may be provided on the bottom of the introduction chamber 63, 84 of the second or third embodiment. Further, the ink absorption bodies of the recovery reservoir 25, 50, 80 may impregnated with the defoaming liquid 105 directly. In this case, the defoaming liquid 105 may be applied to or impregnated in a portion immediately below the discharge port 22*a* and the vicinity of the discharge port 22*a*. In this manner, the bubbles are removed from the waste ink at a focal position, immediately after the waste ink is dropped from the discharge port 22*a*. This improves the defoaming performance of the defoaming liquid 105. If a moisturizing agent such as glycerin is added to the defoaming liquid 105, the viscosity of the waste ink is prevented from increasing.

In each of the illustrated embodiments, the recovery reservoir 25, 50, 80 may accommodate an absorption body or a diffusion sheet in which the waste ink diffuses. For example, in the first or second embodiment, the first ink absorption body 27, 54 for receiving the waste ink from the discharge port 22*a* may be formed of porous material having a relatively high porosity rate and a relatively low density. That is, since such material includes a relatively great number of pores or is rough, the material is highly permeable to the waste ink. Thus, after the waste ink is received by the first ink absorption body 27, 54 and allowed to diffuse along the bottom of the recovery space S entirely, the waste ink is absorbed by the second ink absorption body 28, 55 and the third ink absorption body 29, 56, which exhibit relatively high liquid retaining performance (water absorption performance).

Figure 18:
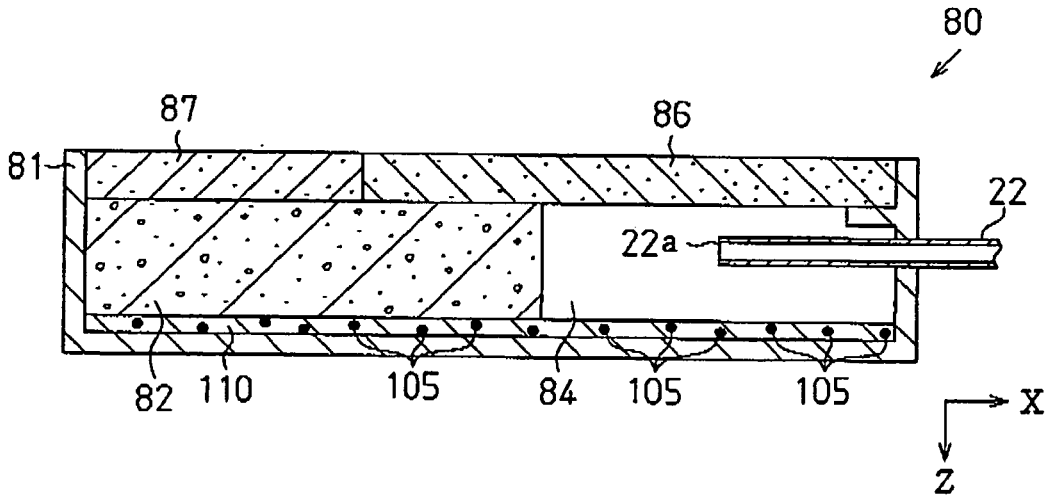
FIG. 18 is a cross-sectional view showing another modification of the recovery reservoir.

As in the recovery reservoir 80 of the third embodiment, if the waste ink is directly dropped on the bottom of the container 81, a diffusion sheet may be provided on the bottom of the container 81 for allowing the waste ink to diffuse in the diffusion sheet. For example, in the third embodiment, as shown in FIG. 18, a diffusion sheet 110 may be provided on the inner bottom surface of the container 81 as a lowermost layer. The size of the diffusion sheet 110 corresponds to the size of the inner bottom surface of the container 81. The first ink absorption body 82 is disposed on the diffusion sheet 110. The diffusion sheet 110 is formed of material having a density lower (a porosity rate higher) than that of the material of the first ink absorption body 82. This allows the waste ink received by the surface of the diffusion sheet 110 to permeate the entire portion of the diffusion sheet 110. The waste ink is then absorbed by the first ink absorption body 82, which is located on the diffusion sheet 110. If the first ink absorption body 27, 54 of the first or second embodiment or the diffusion sheet 110 is impregnated or coated with the defoaming liquid 105 or the moisturizing agent such as glycerin, the defoaming performance and the protection performance of the first ink absorption body 27, 54 or the diffusion sheet 110 are improved. The waste ink is thus allowed to diffuse smoothly in the entire portion of the recovery reservoir 25, 50, 80.

In each of the illustrated embodiments, the liquid ejection apparatus is embodied as the inkjet type printer. However, the liquid ejection apparatus may be a type used for the fabrication of color filters of liquid crystal displays or pixels of organic EL displays.

The present examples and embodiments are to be considered as illustrative and not restrictive and the invention is not to be limited to the details given herein, but may be modified within the scope and equivalence of the appended claims.

The invention claimed is:

1. A liquid recovery container comprising:

a liquid absorption body which absorbs liquid discharged from a discharge port of a liquid ejection apparatus, the liquid absorption body having an introduction chamber which communicates with the discharge port, wherein the introduction chamber is a cavity in the liquid absorption body;

a container body which accomodates the liquid absorption body therein; and a cover member which covers an opening in the container body, and which has an opening therein;

wherein the cover member covers the introduction chamber and at least a portion of the liquid absorption body in a vicinity of the introduction chamber such that volatilization of liquid discharged from the discharge port is suppressed in the vicinity of the introduction chamber; and wherein at least some liquid discharged from the discharge port into the absorption body volatilizes through the opening in the cover member; and wherein the introduction chamber has an inner wall formed from an inner wall of the container body.

2. The container according to claim 1, wherein:

the cover member covers at least a space encompassing the discharge port.

3. The liquid recovery container according to claim 1, wherein the liquid recovery container recovers only the liquid discharged from the discharge port.

4. The liquid recovery container according to claim 1, wherein a portion of the liquid absorption body that is not covered with the cover member is used only for the volatilization of the liquid.

5. A liquid recovery container having a liquid absorption body for absorbing a liquid and a container body for accommodating the liquid absorption body, a discharge port being provided for discharging the liquid toward the container body and the liquid absorption body, some of the liquid discharged from the discharge port and absorbed by the liquid absorption body being allowed to volatilize from an opening defined in a cover member of the container body, the container comprising:

the cover member covering the discharge port and at least a portion of the liquid absorption body in the vicinity of the discharge port for suppressing volatilization of the liquid discharged from the discharge port wherein the cover member includes:

a shutter portion having a surface opposed to an upper surface of the liquid absorption body, the surface being formed in a size smaller than the size of the upper surface of the liquid absorption body;

wherein a portion of the upper surface of the liquid absorption body is exposed to the exterior via the opening.

6. A liquid recovery container having a liquid absorption body for absorbing a liquid and a container body for accommodating the liquid absorption body, a discharge port being provided for discharging the liquid toward the container body and the liquid absorption body, some of the liquid discharged from the discharge port and absorbed by the liquid absorption body being allowed to volatilize from an opening defined in a cover member of the container body, the container comprising:

the cover member covering the discharge port and at least a portion of the liquid absorption body in the vicinity of the discharge port for suppressing volatilization of the liquid discharged from the discharge port;

wherein the cover member comprises a lid arranged in the container body for covering the discharge port; and wherein the lid entirely covers an opening of the container body, and the opening in the cover member is a communication hole through the lid, in a portion of the lid spaced horizintally from a bortion of the lid immediately above the discharge port.

7. The container according to claim 6, wherein the communication hole is defined outside an area of the lid facing to the liquid absorption body.

8. The container according to claim 3, wherein a seal member is arranged between the container body and the cover member.

9. The container to claim 8, wherein a positioning means for positioning the seal member is formed in at least one of the container body and the cover member.

10. The container according to claim 8, wherein the seal member has an elongated shape and is arranged along an upper edge of the container body, opposing ends of the seal member being joined together.

11. The container according to claim 10, wherein a seal material is fitted in a space between the opposing ends of the seal member, thereby joining the opposing ends.

12. The container according to claim 6, wherein the communication hole opens upwardly.

13. The container according to claim 6, wherein:

the container body includes a projection piece projecting from the container body; and the lid includes a projection defining a space communicating with the interior of the container body through engagement with the projection piece, the communication hole being defined in the projection.

14. A liquid recovery container having a liquid absorption body for absorbing a liquid and a container body for accommodating the liquid absorption body, a discharge port being provided for discharging the liquid toward the container body and the liquid absorption body, some of the liquid discharged from the discharge port and absorbed by the liquid absorption body being allowed to volatilize from an opening defined in a cover member of the container body, the container comprising:

the cover member covering the discharge port and at least a portion of the liquid absorption body in the vicinity of the discharge port for suppressing volatilization of the liquid discharged from the discharge port;

wherein the cover member is formed of a material that absorbs the liquid.

15. The container according to claim 14, wherein:

a recess is defined in a side surface of the cover member; and the discharge port is located in a space defined by the recess and the container body.

16. The container according to claim 14, wherein:

the cover member is formed by a first cover member for covering an area spaced from the discharge port and a second cover member formed of a material having a density higher than the density of the first cover member and covering the discharge port and the vicinity of the discharge port.

17. A liquid recovery container having a liquid absorption body for absorbing a liquid and a container body for accommodating the liquid absorption body, a discharge port being provided for discharging the liquid toward the container body and the liquid absorption body, some of the liquid discharged from the discharge port and absorbed by the liquid absorption body being allowed to volatilize from an opening defined in a cover member of the container body, the container comprising;

the cover member covering the discharge port and at least a portion of the liquid absorption body in the vicinity of the discharge port for suppressing volatilization of the liquid discharged from the discharge port;

wherein a height of the discharge port is offset toward the cover member with respect to an intermediate position between the cover member and a component receiving the liquid from the discharge port.

18. A liquid recovery container comprising:

a liquid absorption body which absorbs liquid discharged from a discharge port of a liquid ejection apparatus, the liquid absorption body having an introduction chamber which communicates with the discharge port, wherein the introduction chamber is a cavity in the liquid absorption body;

a container body which accomodates the liquid absorption body therein, and a cover member which covers an opening in the container body, and which has an opening therein, wherein the cover member covers the introduction chamber and at least a portion of the liquid absorption body in the vicinity of the introduction chamber such that volatilization of liquid discharged from the discharge port is suppressed in the vicinity of the introduction chamber;

wherein at least some liquid discharged from the discharge port into the absorption body volatizes through the opening in the cover member;

wherein the container body has a bottom at which the liquid absroption body is located;

wherein the liquid absorption body has a first surface covered by the cover member in the vicinity of the introduction chamber and a second surface exposed from the opening in the cover member;

wherein the second surface is located at a position higher than the first surface in the gravity direction.

19. The liquid recovery container according to claim 18, wherein the introduction chamber has an inner wall formed from an inner wall of the container body.

* * * * *

UNITED STATES PATENT AND TRADEMARK OFFICE

CERTIFICATE OF CORRECTION

PATENT NO. : 7,661,790 B2
APPLICATION NO. : 11/188108
DATED : February 16, 2010
INVENTOR(S) : Harada et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 451 days.

Signed and Sealed this

Twenty-eighth Day of December, 2010

David J. Kappos

David J. Kappos
*Director of the United States Patent and Trademark Office*